US008913933B2

(12) United States Patent
Maeyama et al.

(10) Patent No.: US 8,913,933 B2
(45) Date of Patent: Dec. 16, 2014

(54) PAPER CONVEYING DEVICE, IMAGE FORMING APPARATUS, AND PUSH-IN AMOUNT ADJUSTING METHOD

(71) Applicant: Konica Minolta, Inc., Chiyoda-ku, Tokyo (JP)

(72) Inventors: Takeshi Maeyama, Ikeda (JP); Hirofumi Nakagawa, Takatsuki (JP)

(73) Assignee: Konica Minolta, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/064,584

(22) Filed: Oct. 28, 2013

(65) Prior Publication Data

US 2014/0125004 A1 May 8, 2014

(30) Foreign Application Priority Data

Nov. 7, 2012 (JP) ..... 2012-245564

(51) Int. Cl.
*G03G 15/01* (2006.01)
*B65H 7/06* (2006.01)
*B65H 3/06* (2006.01)

(52) U.S. Cl.
CPC ..... *B65H 7/06* (2013.01); *B65H 3/0676* (2013.01)
USPC ..... 399/302

(58) Field of Classification Search
CPC ..... G03G 15/1605; G03G 15/161; G03G 15/1615; G03G 15/162
USPC ..... 399/302
See application file for complete search history.

(56) References Cited

U.S. PATENT DOCUMENTS

| | | | | |
|---|---|---|---|---|
| 7,860,422 | B2 * | 12/2010 | Ogata et al. | 399/76 |
| 8,364,064 | B2 * | 1/2013 | Ashikawa et al. | 399/302 |
| 2004/0165915 | A1 * | 8/2004 | Hirai et al. | 399/302 |
| 2006/0093410 | A1 * | 5/2006 | Hata | 399/302 |
| 2008/0298856 | A1 * | 12/2008 | Koike | 399/302 |
| 2012/0213542 | A1 | 8/2012 | Tsukada et al. | |
| 2014/0125004 | A1 * | 5/2014 | Maeyama et al. | 271/110 |

FOREIGN PATENT DOCUMENTS

| | | | |
|---|---|---|---|
| JP | 6-95526 | A | 4/1994 |
| JP | 10-153929 | A | 6/1998 |
| JP | 2008-281931 | A | 11/2008 |
| JP | 2009-139566 | A | 6/2009 |
| JP | 2011-059175 | A | 3/2011 |
| JP | 2012-014070 | A | 1/2012 |
| JP | 2012-173528 | A | 9/2012 |

OTHER PUBLICATIONS

Japanese Office Action dated Oct. 21, 2014 issued in corresponding Japanese Patent Appln. No. 2012-245564, with English translation (5 pages).

* cited by examiner

*Primary Examiner* — W B Perkey
(74) *Attorney, Agent, or Firm* — Buchanan Ingersoll & Rooney PC

(57) ABSTRACT

A paper conveying device includes an intermediate transfer member and a paper conveying member driven so as to rotate at the same rotational speed, and an adjusting device. On an outer peripheral surface of the intermediate transfer member, an elastic layer is provided. An axes distance between the intermediate transfer member and the paper conveying member is adjusted by the adjusting device so that drive torque for rotating the intermediate transfer member and the paper conveying member at the same rotational speed becomes smaller than a target set value. Accordingly, occurrence of the shear is suppressed without changing a rotational speed ratio of rollers arranged opposite to each other.

10 Claims, 16 Drawing Sheets

PAPER CONVEYING DEVICE, IMAGE FORMING APPARATUS, AND PUSH-IN AMOUNT ADJUSTING METHOD

This application is based on Japanese Patent Application No. 2012-245564 filed with the Japan Patent Office on Nov. 7, 2012, the entire content of which is hereby incorporated by reference.

BACKGROUND OF THE INVENTION

1. Field of the Invention

The present invention relates to a paper conveying device, an image forming apparatus, and a push-in amount adjusting method.

2. Description of the Related Art

Japanese Laid-Open Patent Publication No. 2011-059175 discloses invention related to an image forming apparatus. A controller of this image forming apparatus controls driving of an image bearing body so that a moving speed of a surface of the image bearing body becomes constant or substantially constant, and controls a rotational speed of a transfer roller in accordance with information as to a type of recording paper determined by a paper type determining unit when the recording paper is nipped at a transfer nip. The publication describes that this image forming apparatus can form favorable images on various types of recording paper.

Japanese Laid-Open Patent Publication No. 2012-014070 also discloses invention related to an image forming apparatus. This image forming apparatus includes thickness detecting means, torque setting means, and control means. The thickness detecting means detects a thickness of a recording member. The torque setting means sets torque of a transfer member in accordance with a detection result of the thickness detecting means in a state where the transfer member and an image bearing body are in contact with each other. The control means controls torque of the transfer member so as to have torque set by the torque setting means. The publication describes that, even when a recording member having a large thickness is conveyed to a transfer nip, this image forming apparatus can set a surface speed of the recording member on a side of the image bearing body to be substantially the same as a surface speed of the image bearing member.

Japanese Laid-Open Patent Publication No. 2008-281931 also discloses invention related to an image forming apparatus. According to this image forming apparatus, a surface speed of a secondary transfer roller is adjusted in accordance with a thickness of recording paper passing through a transfer nip portion formed between an intermediate transfer member and a secondary transfer roller. The publication describes that this image forming apparatus can prevent occurrence of a color shift even when thick paper is used since a rotational speed of the secondary transfer roller at the transfer nip portion is adjusted in accordance with a thickness of recording paper.

SUMMARY OF THE INVENTION

The invention disclosed in each of the publications described above suppresses occurrence of a shear by adjusting (increasing and decreasing) a rotational speed ratio of rollers arranged opposite to each other to achieve fine transfer and form an image exhibiting a high quality.

An object of the present invention is to provide a paper conveying device capable of suppressing occurrence of a shear without changing a rotational speed ratio between rollers arranged opposite to each other, an image forming apparatus including such a paper conveying device, and a push-in amount adjusting method being applicable to such a paper conveying device.

A paper conveying device according to the present invention includes an image bearing body bearing an image on a surface and driven so as to rotate at a first rotational speed about a rotational axis as a center of rotation, a paper conveying member conveying recording paper, to which the image is transferred, to a nip portion formed with the image bearing member, the paper conveying member arranged so as to be in press-contact with the image bearing body and driven so as to rotate at a second rotational speed about a rotational axis as a center of rotation, a torque detecting device detecting first driving torque for rotating the image bearing member at the first rotational speed in a state of allowing the recording paper to pass through the nip portion and/or second driving torque for rotating the paper conveying member at the second rotational speed in a state of allowing the recording paper to pass through the nip portion as detection values, and an adjusting device capable of adjusting an axes distance between the rotational axis of the image bearing member and the rotational axis of the paper conveying member. An elastic layer is provided on an outer peripheral surface of the image bearing body and/or on an outer peripheral surface of the paper conveying member. The first rotational speed and the second rotational speed have the same value or have values set such that one value is an integer multiple of the other value. The axes distance is adjusted by the adjusting device so that a sum of the first driving torque for rotating the image bearing body at the first rotational speed and the second driving torque for rotating the paper conveying member at the second rotational speed is smaller than a target set value.

An image forming apparatus according to the present invention includes the paper conveying device according to the present invention and an image forming unit forming the image. The image formed by the image forming unit is sequentially transferred to the image bearing body and the recording paper conveyed by the paper conveying member to form an output image onto the recording paper.

A push-in amount adjusting method according to the present invention is a push-in amount adjusting method for adjusting a push-in amount of a paper conveying member of a paper conveying device with respect to an image bearing body. The paper conveying device includes the image bearing body bearing an image on a surface and rotating about a rotational axis as a center of rotation, the paper conveying member conveying recording paper, to which the image is transferred, to a nip portion formed with the image bearing body, the paper conveying member arranged so as to be in press-contact with the image bearing body and rotating about a rotational axis as a center of rotation, and an adjusting device capable of adjusting an axes distance between the rotational axis of the image bearing body and the rotational axis of the paper conveying member. An elastic layer is provided on an outer peripheral surface of the image bearing body and/or on an outer peripheral surface of the paper conveying member. The push-in amount adjusting method includes a first step of rotating the image bearing body and the paper conveying member so as to have the same value of the rotational speed or have the values of the rotational speeds such that one value is an integer multiple of the other value, a second step of detecting first driving torque of the image bearing body in a state of allowing the recording paper to pass through the nip portion and/or second driving torque of the paper conveying member in a state of allowing the recording paper to pass through the nip portion as a detection values, and a third step of adjusting the axes distance with use of the adjusting device so that a sum of the first driving torque and the second driving torque is smaller than a target set value in accordance with the detection values detected in the second step.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

[Reference Art]

Figure 1:
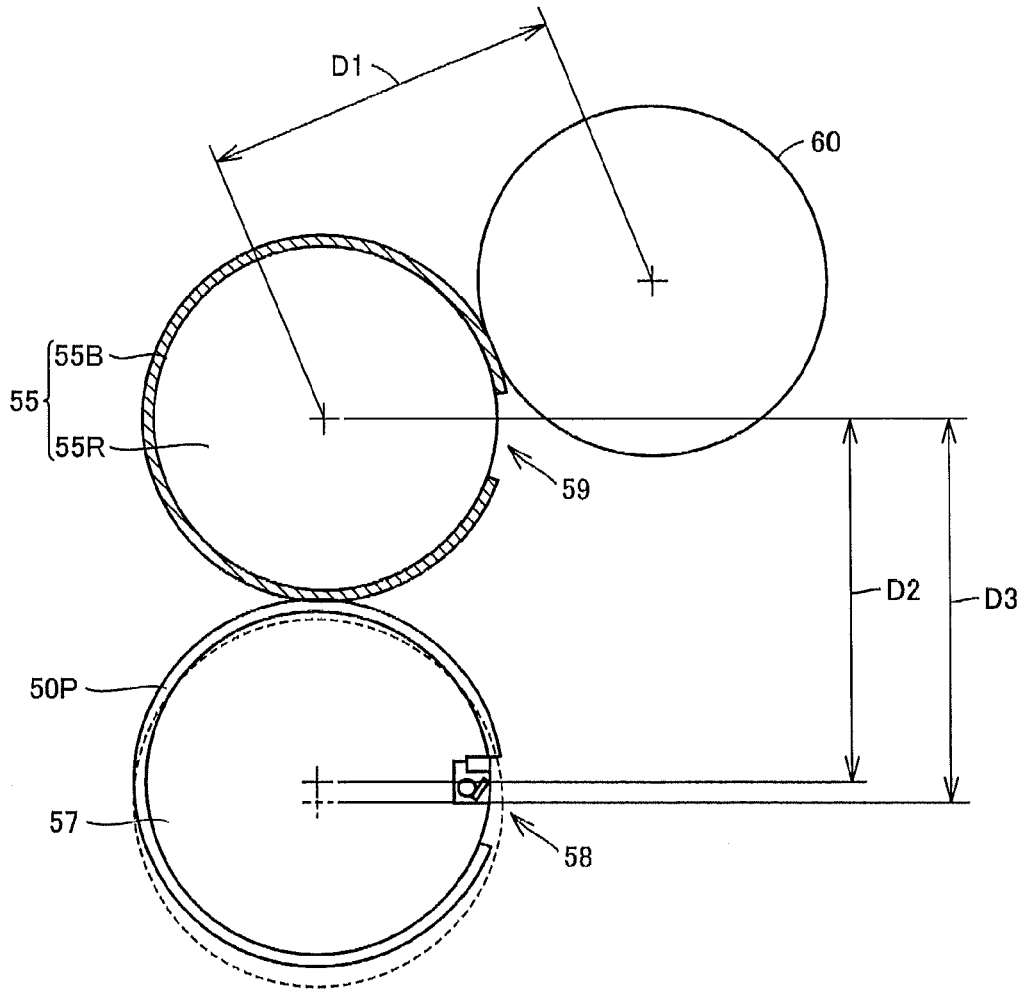
FIG. 1 represents an image forming apparatus according to a reference art.

Before describing each of the embodiments according to the present invention, a reference art related to each embodiment will be described with reference to FIGS. 1-3 hereinafter. FIG. 1 represents an image forming apparatus according to the reference art. This image forming apparatus includes a plate cylinder 60, a blanket cylinder 55R, a blanket 55B, and an impression cylinder 57.

Plate cylinder 60 is a roller-like member. An inking device, not illustrated in the drawings, is applied to a plate formed on a surface of plate cylinder 60. Ink is supplied from the inking device to an image on the plate. Sheet-like blanket 55B having elasticity is wound around the surface of blanket cylinder 55R. Blanket cylinder 55R and blanket 55B serve as one elastic roller 55. Plate cylinder 60 and elastic roller 55 rotate in contact with each other.

Impression cylinder 57 has a gripper 58 on its surface. Impression cylinder 57 rotates in a state where gripper 58 grips a front end portion of recording paper 50P. Elastic roller 55 and impression cylinder 57 also rotate in contact with each other. Recording paper 50P is conveyed along with rotation of impression cylinder 57 and passes through a portion between blanket cylinder 55R (blanket 55B) and impression cylinder 57. Providing gripper 58 on impression cylinder 57 allows recording paper 50P to be conveyed reliably and accurately.

A positional relationship between the rollers is adjusted in the following steps. Firstly, a linear pressure (contact pressure) between plate cylinder 60 and elastic roller 55 is adjusted. A lower winding called under blanket (not illustrated) is wound under blanket 55B of elastic roller 55. An axes distance D1 between plate cylinder 60 and elastic roller 55 is fixed, and the linear pressure is adjusted by the thickness of the lower winding. The thickness of the lower winding is adjusted while monitoring density unevenness and/or dot gain (degree of thickness of halftone dots). An appropriate amount of ink can be transferred from the plate onto a surface of elastic roller 55 (blanket 55B).

Next, a linear pressure between elastic roller 55 and impression cylinder 57 is adjusted. The linear pressure is adjusted by changing an axes distance D2 between elastic roller 55 and impression cylinder 57. In the case where axes distance D2 remains the same before and after the thickness of recording paper 50P used for printing becomes larger, the linear pressure of impression cylinder 57 with respect to elastic roller 55 increases. To have an appropriate value of the linear pressure, axes distance D2 is set to be greater, for example, when the thickness of recording paper 50P becomes larger.

A push-in amount (axes distance) of impression cylinder 57 with respect to elastic roller 55 is prepared as a fixed recommended push-in amount for each printing device. Axes distance D2 is adjusted so that a push-in amount has a desired value in the state where the under blanket (not illustrated) and blanket 55B are wound around blanket cylinder 55R and recording paper 50P is wound around impression cylinder 57. For example, axes distance D2 is increased to an axes distance D3 so that a value of the push-in amount of impression cylinder 57 with respect to elastic roller 55 becomes +1.0 mm as compared to a value prior to the adjustment.

Here, in a digital printing machine as a printing machine employing an electrographic method, a longer longitudinal image forming width is required to form an image on large-sized paper having a size equal to or larger than octavo. An intermediate transfer member, a transfer roller, or the like having a longer longitudinal length is required to have a wider image forming width. In accordance with an increase in the longitudinal length, the weight of the intermediate transfer member, transfer roller, or the like also becomes greater. In the case of dealing with large-sized paper or the like, it is preferable to employ a so-called blanket form of replacing only the elastic layer provided on the surface layer of the intermediate transfer member or the like rather than replacing the whole intermediate transfer member or the like since the work burden is smaller.

To balance both improvement in accuracy of conveying paper with widening of the image forming width, a device configuration with a combination of the gripper and the blanket form is conceivable as one solution. In this configuration, to match the recording paper with the image forming region on the intermediate transfer member, it is necessary to always allow a portion having the gripper and a seam of the blanket to be synchronized with each other. For example, the portion having the gripper and the seam of the blanket can be synchronized by setting a diameter of the intermediate transfer member and a diameter of the paper conveying member to be the same and rotating them at the same rotational speed (same angular speed).

In the image forming apparatus according to the reference art shown in FIG. 1, selection of the thickness of the under blanket is performed not for the purpose of optimizing a ratio between the diameter of elastic roller 55 and the diameter of impression cylinder 57. Selection of the thickness of the under blanket in the image forming apparatus according to the reference art is performed for the purpose of having an appropriate value of the push-in amount (or linear pressure) of plate cylinder 60 with respect to elastic roller 55.

Figure 2:
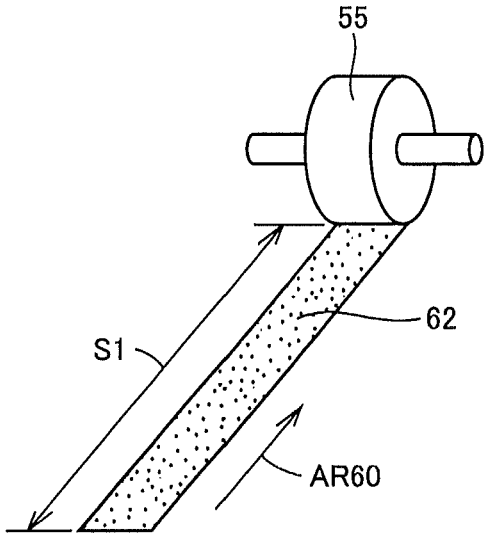
FIG. 2 is a perspective view representing a running distance of an elastic roller, according to the reference art, rotated by one rotation in a state where a load is not applied to the elastic roller.

FIG. 2 is a perspective view schematically representing appearance of the case where elastic roller 55 is rotated by only one rotation with almost no load applied with respect to elastic roller 55 and is moved in the direction of an arrow AR60. Referring to FIG. 2, in this state, elastic roller 55 proceeds only by a distance S1 (running distance) in the direction of arrow AR60, and ink 62 corresponding to this distance S1 is applied to a surface of recording paper or the like.

Figure 3:
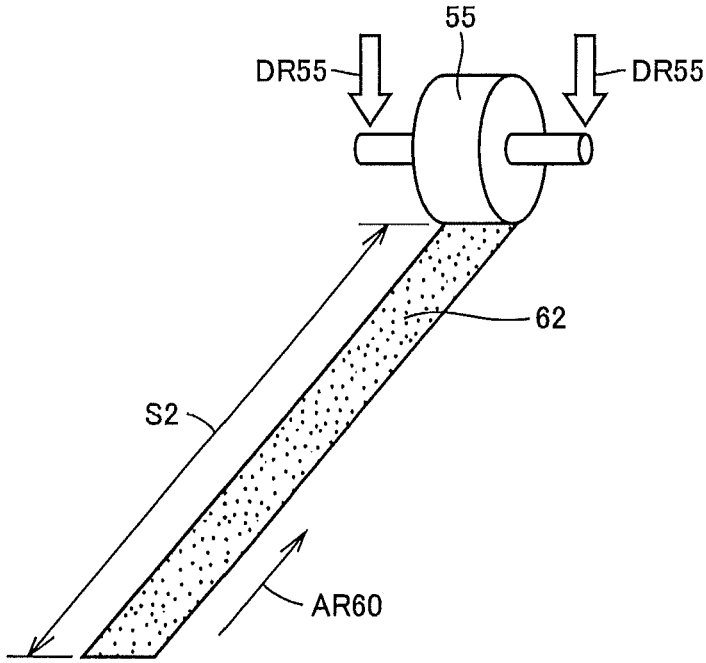
FIG. 3 is a perspective view representing a running distance of the elastic roller, according to the reference art, rotated by one rotation in a state where a load is applied to the elastic roller.

FIG. 3 is a perspective view schematically representing appearance of the case where elastic roller 55 is rotated by one rotation with a predetermined load applied with respect to elastic roller 55 (in the direction of arrows DR55) and is moved in the direction of arrow AR60. Referring to FIG. 3, in this state, the surface of elastic roller 55 is elastically deformed due to the push-in operation with respect to the recording paper or the like.

An effective driving diameter of elastic roller 55 in FIG. 3 is longer than an effective driving diameter of elastic roller 55 in FIG. 2. During one rotation of elastic roller 55, this elastic roller 55 proceeds by a distance S2 in the direction of arrow AR60, and ink 62 corresponding to this distance S2 is applied to the surface of the recording paper or the like. Distance S2 shown in FIG. 3 is longer than distance S1 shown in FIG. 2. It is known that such phenomenon of deforming and rotating the elastic body causes a difference in the effective driving diameter of the roller in accordance with a deformed amount of the elastic body to cause the running distance to deviate from a diameter×a rotational speed.

Referring back to FIG. 1, an elastic layer is provided to one surface or both surfaces of elastic roller 55 and impression cylinder 57 to form a favorable transfer nip (here, blanket 55B having elasticity is provided on the surface of blanket cylinder 55R). When impression cylinder 57 is pushed into elastic roller 55, and an image is transferred in the state where blanket 55B having elasticity is elastically deformed, a difference occurs between an effective driving diameter of elastic roller 55 and an effective driving diameter of impression cylinder 57 in accordance with the amount of deformation of blanket 55B.

Since a hardness of the surface of elastic roller 55 and a hardness of the surface of impression cylinder 57 are not the same, when the diameters and the rotational speeds of the rollers are set to be the same, and these rollers are used while being pushed into each other, a relative speed occurs between the surfaces of these rollers. In the configuration of the image forming apparatus according to the reference art, in the case where the paper thickness of the recording paper used as recording paper 50P is changed, adjustment is made so as to change a ratio between a diameter of elastic roller 55 and a diameter of impression cylinder 57 while the push-in amount (linear pressure) of impression cylinder 57 with respect to elastic roller 55 becomes constant.

In the configuration of the image forming apparatus according to the reference art, selection of the thickness of the under blanket is not set for a state where driving torque is minimum with respect to all of paper thicknesses, in other words, for a state where no shear occurs between the surface of recording paper 50P and the surface of blanket 55B. When the rotational speed of elastic roller 55 and the rotational speed of impression cylinder 57 are set to have the same value, even though synchronization between the rotation of the portion provided with the gripper and the rotation of seam 59 of the blanket can be secured, the surface of elastic roller 55 and the surface of impression cylinder 57 are always in the state of moving with a relative speed.

Thus, in the configuration of the image forming apparatus according to the reference art, when elastic roller 55 and impression cylinder 57 are driven at the same rotational speed, the state where a shear readily occurs between the surface of recording paper 50P and the surface of blanket 55B is formed, and the shear stress applied to the surface of the members causes wearing of members, an increase in power consumption due to rise in driving torque, distortion in an image, or the like to be likely to occur.

During the actual use, a thickness of recording paper 50P is also added to a substantive diameter of impression cylinder 57. The thickness of recording paper 50P is changed in accordance with a type of recording paper SOP to be used, and the substantive diameter of impression cylinder 57 is also changed in accordance with the thickness of recording paper 50P. For use always without a relative speed between the surfaces even when a paper type of recording paper 50P is changed, it is necessary to configure such that the relative speed is cancelled out with respect to a range of change in diameter (assumed change in paper thickness) of impression cylinder 57.

[Embodiments]

Hereinafter, each of the embodiments according to the present invention will be described with reference to the drawings. In the description of each embodiment, when the number, quantity, and the like are described, the scope of the present invention is not necessarily limited to the number, quantity, and the like unless specifically noted. In the description of each embodiment, the same parts and corresponding parts have the same reference numerals allotted, and description thereof will not be repeated in some cases.

[First Embodiment]

Figure 4:
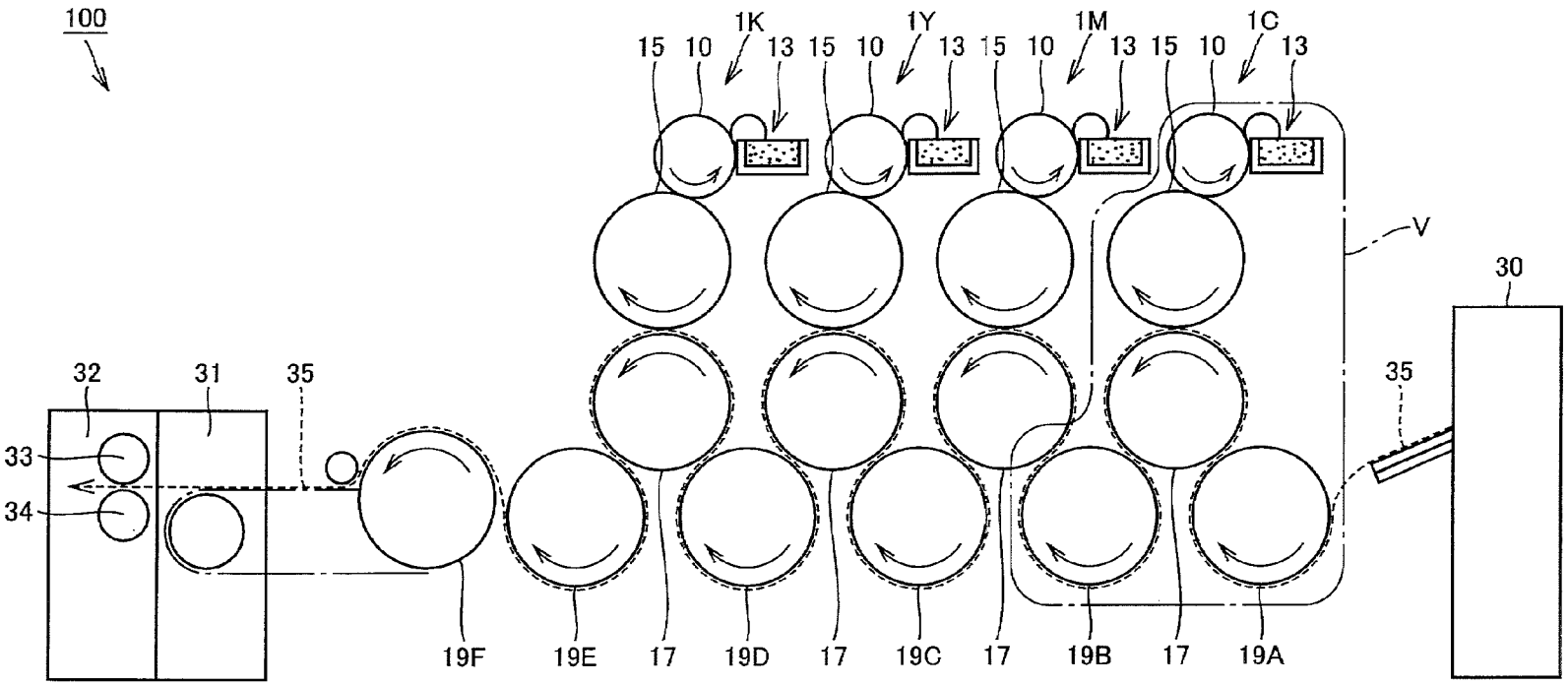
FIG. 4 represents an image forming apparatus according to a first embodiment.

FIG. 4 represents an image forming apparatus 100 in accordance with the present embodiment. Image forming apparatus 100 is a so-called wet-type image forming apparatus, and forms an image with use of a liquid developer containing toner dispersed in carrier liquid. Image forming apparatus 100 includes image forming units 1C, 1M, 1Y, 1K as image forming units, four paper conveying members 17, delivery members 19A, 19B, 19C, 19D, 19E, 19F, a paper-supplying unit 30, a paper-discharging unit 31, and a fixing device 32.

Image forming units 1C, 1M, 1Y, 1K have substantially the same configuration. Fixing device 32 includes fixing rollers 33, 34. In image forming apparatus 100, a paper conveyance passage 35 for conveying recording paper (not illustrated) is formed between paper conveying members 17 and each delivery member. On the surface of the recording paper, images of respective colors are formed by image forming units 1C, 1M, 1Y, 1K and paper conveying members 17, and the recording paper is sequentially conveyed to a downstream side.

Figure 5:
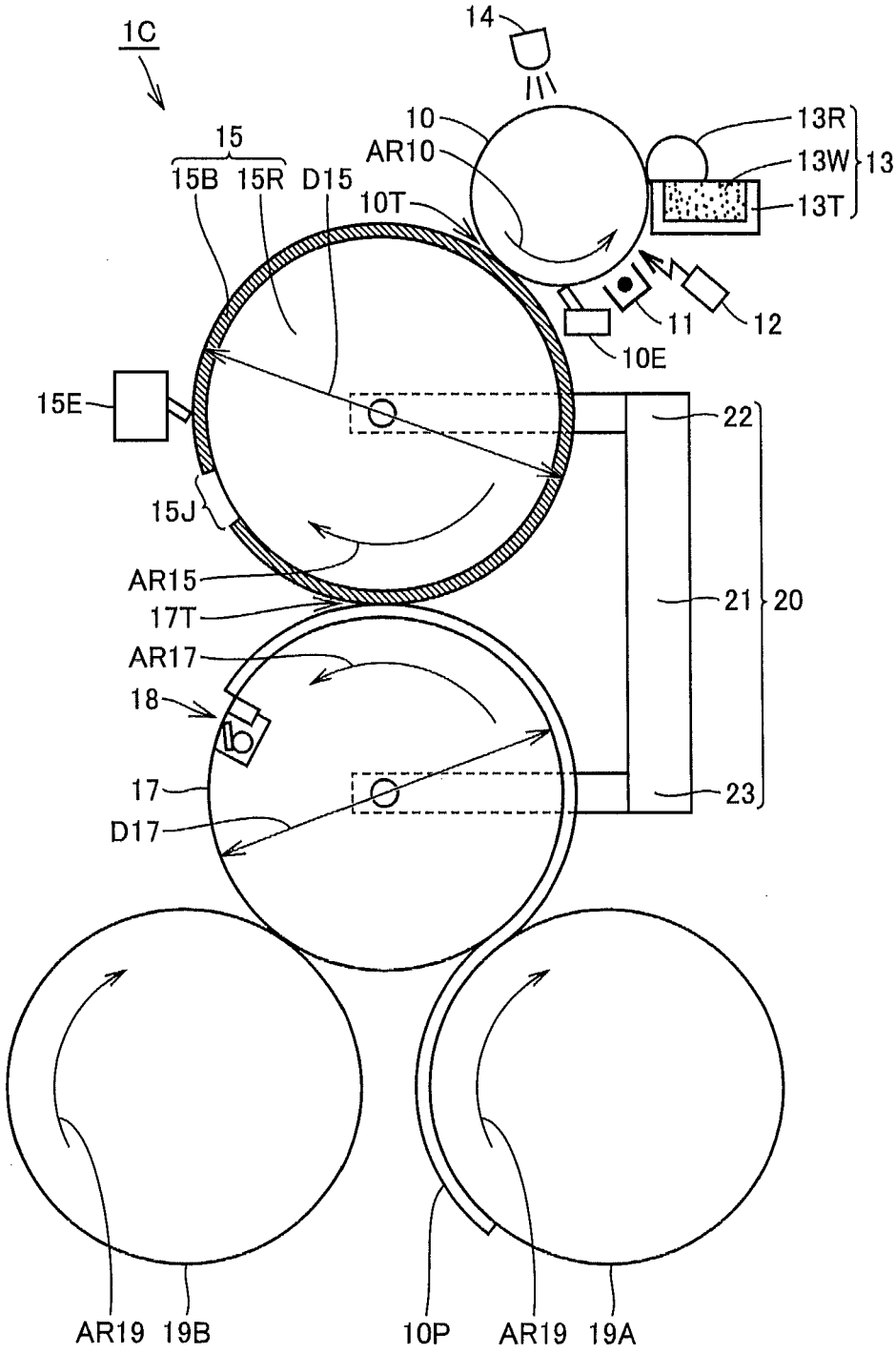
FIG. 5 is an enlarged view of a region surrounded by the V-line in FIG. 4.

In FIG. 5 is an enlarged view representing the region surrounded by the V-line in FIG. 4. Referring to FIG. 5, details of image forming unit 1C and the like will be described. Since image forming units 1M, 1Y, 1K in FIG. 4 are configured similarly to image forming unit 1C, detailed description thereof will not be repeated. Image forming unit 1C includes a photoconductor 10, a cleaning device 10E, a charging device 11, an exposure device 12, a liquid developing device 13, an eraser 14, an intermediate transfer member 15, and a cleaning device 15E.

Photoconductor 10 is a member having a cylindrical shape, and a photoconductor layer (not illustrated) is formed on its surface. Photoconductor 10 rotates in the direction of an arrow AR10 about a rotational axis as a center of rotation. On an outer circumference of photoconductor 10, there are cleaning device 10E, charging device 11, exposure device 12, liquid developing device 13, eraser 14, and intermediate transfer member 15 arranged along the rotational direction of photoconductor 10.

(Developing Process)

Charging device 11 uniformly charges the surface of photoconductor 10 to a predetermined electric potential. Exposure device 12 irradiates the surface of photoconductor 10 with light based on image information. Charging level in the irradiated region on the surface of photoconductor 10 is lowered, and an electrostatic latent image is formed on the surface of photoconductor 10. Liquid developing device 13 includes a storage tank 13T, a liquid developer 13W, and a developing roller 13R. Liquid developer 13W is stored in storage tank 13T. A part of developing roller 13R is dipped in storage tank 13T.

A developing bias voltage is applied from a power supply (not illustrated) to developing roller 13R. By the effect of an electric field formed between developing roller 13R and the electrostatic latent image on photoconductor 10, the toner in liquid developer 13W is electrostatically absorbed on the electrostatic latent image portion of photoconductor 10. The electrostatic latent image on photoconductor 10 is developed as a toner image (image).

Liquid developer 13W used in the present embodiment contains carrier liquid as a solvent and colored toner particles. A dispersing agent, a charge controlling agent, and the like may be added to liquid developer 13W. A non-volatile solvent which is insulative and does not volatilize at a normal temperature is used as the carrier liquid. Examples of the non-volatile solvent to be used include silicon oil, mineral oil, or paraffin oil.

The toner particles are constituted by resin, and pigment or dye for coloring. The resin has the function of dispersing the pigment or dye uniformly in the resin, and the function as a binder during fixation of the toner particles on recording paper 10P. Examples of the resin to be used include thermoplastic resin such as polystyrene resin, styrene-acrylic resin, acrylic resin, polyester resin, epoxy resin, polyamide resin, polyimide resin, or polyurethane resin. A plurality of resins selected from these resins can be mixed and used for the toner particles.

Commercially available pigments or dyes can be used to color the toner. Examples of the pigment to be used include carbon black, iron red, titanium oxide, silica, phthalocyanine blue, phthalocyanine green, sky blue, benzidine yellow, or lake red D. Examples of the dye to be used include Solvent Red 27 or Acid Blue 9.

Liquid developer 13W can be prepared with a generally used method. For example, the resin and pigment blended at a predetermined ratio are melted and kneaded using a pressure kneader, a roll mill, or the like. The resultant dispersive product obtained by uniformly dispersing the resin and pigment is finely ground by a jet mill, for example. The resultant fine powders obtained by fine grinding are classified by a wind classifier. Colored toner having a predetermined particle size is obtained. The resultant colored toner and the insulative liquid serving as the carrier liquid are mixed with each other at a predetermined ratio. This mixture is uniformly dispersed by dispersing means such as a ball mill. In the manner described above, liquid developer 13W is obtained.

Preferably, the toner particles in liquid developer 13W have a volume-average particle size of not less than 0.1 μm and not more than 5 μm. If the toner particles in liquid developer 13W have a volume-average particle size of not less than 0.1 μm, the toner particles can readily develop a electrostatic latent image. If the toner particles in liquid developer 13W have a volume-average particle size of not more than 5 μm, a toner image formed with those toner particles will have a higher quality.

Preferably, a ratio of the mass of the toner particles to the mass of liquid developer 13W is not less than 10% and not more than 50%. If the ratio of the mass of the toner particles to the mass of liquid developer 13W is not less than 10%, sedimentation of the toner particles becomes less likely to occur, resulting in improvement in stability over time during long-term storage of liquid developer 13W. If the ratio of the mass of the toner particles to the mass of liquid developer 13W is not less than 10%, it is not necessary to supply a large amount of liquid developer 13W in order to obtain a desired image density. The amount of carrier liquid to be supplied to recording paper 10P does not increase, resulting in no need to dry the large amount of carrier liquid when fixing a toner image 91. This is preferable because a large amount of vapor is not generated from the carrier liquid when the carrier liquid is dried. If the mass of the toner particles to the mass of liquid developer 13W is not more than 50%, the viscosity of liquid developer 13W becomes appropriate, which is advantageous in terms of manufacturing and handling.

Preferably, liquid developer 13W has a viscosity of not less than 0.1 mPa·s and not more than 10000 mPa·s at 25° C. If liquid developer 13W has a viscosity of not less than 10000 mPa·s, it is easy to handle liquid developer 13W during agitation and delivery of liquid developer 13W. This reduces a burden on the device in order to obtain uniform liquid developer 13W.

(Transfer Process)

An intermediate transfer member 15 (image bearing body) is arranged so as to be in press-contact with photoconductor 10. Intermediate transfer member 15 is driven by an intermediate transfer member driving device 15V (refer to FIG. 7), and rotates in the direction of an arrow AR15. Intermediate transfer member 15 of the present invention includes a base member 15R and an elastic layer 15B, and rotates at a first rotational speed (fixed value). Elastic layer 15B is a sheet-like member constituting an outer peripheral surface of intermediate transfer member 15, and a seam 15J (stepped portion), which is a portion having no elastic layer 15B, is formed on intermediate transfer member 15. This seam 15J extends in an axial direction of intermediate transfer member 15. Intermediate transfer member 15 including elastic layer 15B has an outer diameter D15.

Figure 6:
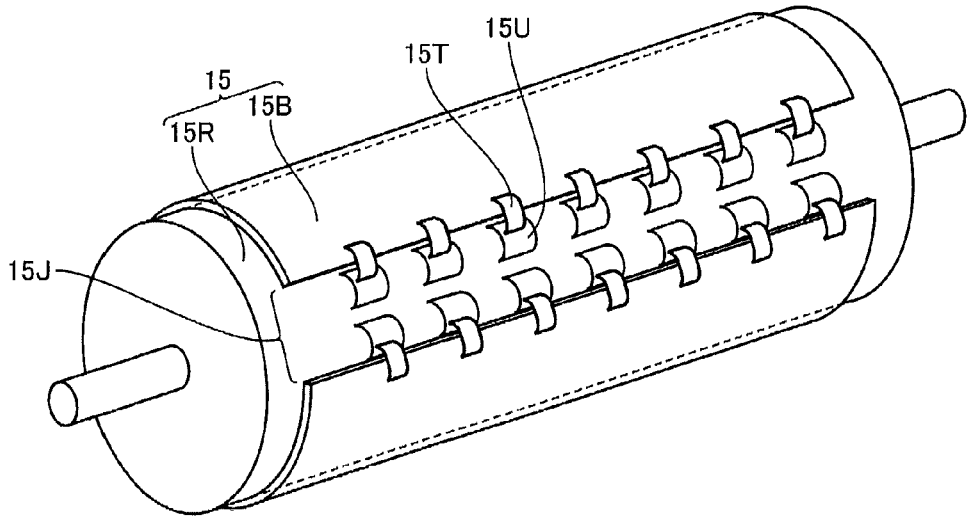
FIG. 6 is a perspective view representing an image bearing body (intermediate transfer member) according to the first embodiment.

FIG. 6 is a perspective view representing intermediate transfer member 15 of the present embodiment. At both ends in the circumferential direction of elastic layer 15B, a plurality of claw portions 15T are provided. On the surface of base member 15R, a plurality of locking portions 15U are provided so as to correspond respectively to the plurality of claw portions 15T. Elastic layer 15B is configured to be replaceable with respect to base member 15R, and the plurality of claw portions 15T are locked respectively onto the plurality of locking portions 15U, so that elastic layer 15B is fixed to base member 15R.

Referring back to FIG. 5, a toner image formed on the surface of photoconductor 10 is primarily transferred onto intermediate transfer member 15 at a nip portion 10T formed between photoconductor 10 and intermediate transfer member 15. After the toner image is transferred to intermediate transfer member 15, cleaning device 10E removes residual toner on photoconductor 10.

Paper conveying member 17 is arranged so as to be in press-contact with intermediate transfer member 15. Paper conveying member 17 is constituted by, for example, a rigid body. Paper conveying member 17 is driven by a paper conveying member driving device 17V (refer to FIG. 7), and rotates in the direction of an arrow AR17 about a rotational axis as a center of rotation. Paper conveying member 17 rotates at a second rotational speed (fixed value). In the present embodiment, a rotational speed (first rotational speed) of intermediate transfer member 15 and a rotational speed (second rotational speed) of paper conveying member 17 have the same value. On a surface of paper conveying member 17, a gripper 18 (gripping member) is provided. A stepped portion is formed at a position where gripper 18 is arranged, and this stepped portion extends in the axial direction of paper conveying member 17. Paper conveying member 17 has an outer diameter D17.

Although the details will be described later, an axes distance between intermediate transfer member 15 and paper conveying member 17 is increased or decreased (adjusted) by an adjusting device 20. Adjusting device 20 includes arm portions 22, 23 respectively supporting intermediate transfer member 15 and paper conveying member 17, and a shaft portion 21. The axes distance between intermediate transfer member 15 and paper conveying member 17 is adjusted by movement of arm portion 22 and arm portion 23 attached to shaft portion 21.

Between intermediate transfer member 15 and intermediate transfer member driving device 15V (refer to FIG. 7), and/or between paper conveying member 17 and paper conveying member driving device 17V (refer to FIG. 7), a torque detecting device 41 (refer to FIG. 7) is provided. A controller 40 (refer to FIG. 7) as a control unit controls driving of adjusting device 20 in accordance with information received from torque detecting device 41, and adjusts the axes distance between intermediate transfer member 15 and paper conveying member 17.

The toner image on intermediate transfer member 15 is conveyed to nip portion 17T formed between intermediate transfer member 15 and paper conveying member 17. A transfer bias voltage is applied from a power supply (not illustrated) to paper conveying member 17, so that an electric field is formed between intermediate transfer member 15 and paper conveying member 17. Recording paper 10P, is wound around paper conveying member 17 while being gripped at its front end portion by gripper 18, and then passes through nip portion 17T formed between intermediate transfer member 15 and paper conveying member 17.

The toner image formed on intermediate transfer member 15 is electrostatically absorbed on recording paper 10P by the effect of the electric field formed between intermediate transfer member 15 and paper conveying member 17, and transferred onto recording paper 10P. After the toner image is transferred onto recording paper 10P, cleaning device 15E removes residual toner on intermediate transfer member 15. Details about the drive control of adjusting device 20 and setting of the push-in amount (or linear pressure) between intermediate transfer member 15 and paper conveying member 17 at nip portion 17T will be described later.

Referring back to FIG. 4, recording paper 10P is conveyed sequentially to the downstream side by delivery members 19A, 19B, 19C, 19D, 19E, 19F (refer to FIG. 4) rotating in the direction of arrow AR19. When recording paper 10P is conveyed, image forming units 1C, 1M, 1Y, 1K (refer to FIG. 4) form toner images of respective colors on the surface of recording paper 10P. In image forming apparatus 100 configured as described above, a paper conveying device for conveying recording paper 10P is constituted by intermediate transfer member 15, paper conveying member 17, adjusting device 20 (refer to FIG. 5), and the like.

(Fixing Process)

Recording paper 10P to which the toner image is transferred is conveyed further along paper conveyance passage 35 and delivered to fixing device 32. Fixing device 32 includes fixing rollers 33, 34. Fixing rollers 33, 34 have respective heat sources, and rotate in contact with each other. When recording paper 10P passes through fixing rollers 33, 34, recording paper 10P is heated and pressed. The toner included in the toner image on recording paper 10P is fused on recording paper 10P, and fixed as an output image on the surface of recording paper 10P. Thereafter, recording paper 10P is discharged, and normal image forming process conducted by image forming apparatus 100 with respect to one recording paper 10P is completed.

(Outer Diameter Ratio)

Figure 7:
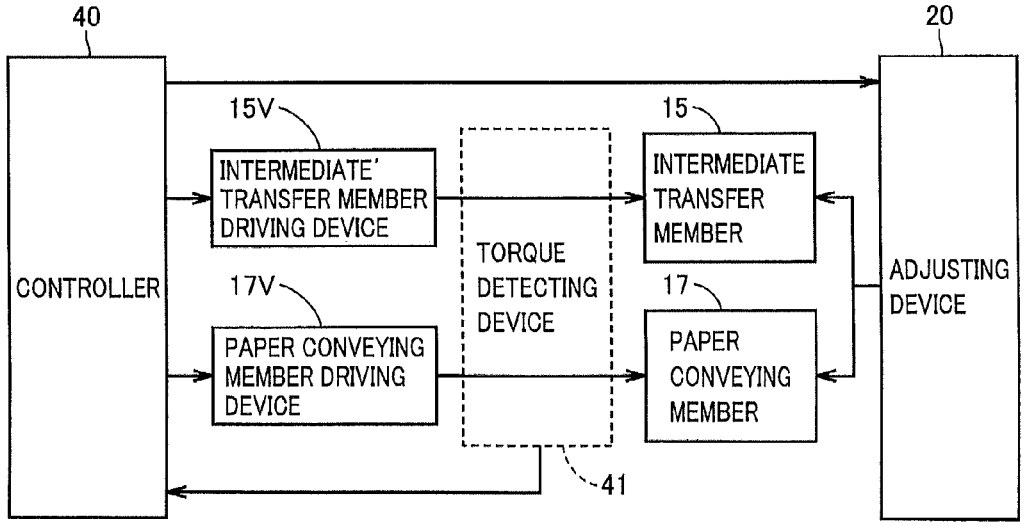
FIG. 7 represents control blocks of the image forming apparatus according to the first embodiment.

Referring to FIG. 7, intermediate transfer member 15 is driven by intermediate transfer member driving device 15V as described above. Paper conveying member 17 is driven by paper conveying member driving device 17V. Intermediate transfer member driving device 15V and paper conveying member driving device 17V are controlled by controller 40. Intermediate transfer member driving device 15V drives intermediate transfer member 15 so as to rotate at the first rotational speed, and paper conveying member driving device 17V drives paper conveying member 17 so as to rotate at the second rotational speed. In the present embodiment, the first rotational speed and the second rotational speed have the same value.

Between intermediate transfer member 15 and intermediate transfer member driving device 15V, and/or between paper conveying member 17 and paper conveying member driving device 17V, torque detecting device 41 is provided. Torque detecting device 41 detects driving torque of intermediate transfer member 15 and/or driving torque of paper conveying member 17 as a detection value. Controller 40 controls adjusting device 20 in accordance with information received from torque detecting device 41, and adjusts the axes distance between intermediate transfer member 15 and paper conveying member 17.

As described above, in image forming apparatus 100 of the present embodiment, paper conveying member 17 having gripper 18 for gripping recording paper 10P and intermediate transfer member 15 provided with sheet-like elastic layer 15B having elasticity at least at a part in the thickness direction on the surface of base member 15R as a rigid body are used. The transfer to recording paper 10P is conducted with a combination of paper conveying member 17 having gripper 18 and intermediate transfer member 15 around which sheet-like elastic layer 15B is wound.

Intermediate transfer member 15 has a portion provided with seam 15J rendering the member surface be not endless, and paper conveying member 17 has a portion provided with gripper 18 rendering the member surface be not endless. Intermediate transfer member 15 and paper conveying member 17 in image forming apparatus 100 have such a circumferential length enabling formation of continuous one image on one recording paper 10P (paper sheet) to be used for printing.

In other words, the circumferential length of intermediate transfer member 15 and the circumferential length of paper conveying member 17 are set so as to be not less than the length of one sheet (or its integer multiple) of the paper size covered by image forming apparatus 100. Image forming is carried out so as to avoid the portion (stepped portion) provided with gripper 18 and the portion (stepped portion) provided with seam 15J. To transfer an entire toner image on intermediate transfer member 15 to recording paper 10P collectively, intermediate transfer member 15 and paper conveying member 17 are synchronized to have the same rotational speed (equal angular speed). Specifically, seam 15J of intermediate transfer member 15 and gripper 18 of paper conveying member 17 are synchronized in terms of the timings of passing through nip portion 17T between intermediate transfer member 15 and paper conveying member 17.

Under such a condition, outer diameter D15 of intermediate transfer member 15 including elastic layer 15B and the outer diameter of paper conveying member 17 in the state of gripping recording paper 10P to be used are set so as to be 1:1, so that image forming which is favorable to some extent can be conducted. The surface speeds of these members are the same in the state where paper conveying member 17 is pushed into intermediate transfer member 15. However, in the case where the members have different elasticity due to the fact that the surface of one (or both) member has elasticity, and the members are used while being pushed in during the actual use (by the phenomenon described with reference to FIGS. 2 and 3), a difference in effective driving diameters of intermediate transfer member 15 and paper conveying member 17 occurs during the actual use, causing a shear to be likely to occur between the surfaces of intermediate transfer member 15 and paper conveying member 17 (relative speed between the surfaces).

In image forming apparatus 100, intermediate transfer member 15 having a value of outer diameter D15 set slightly small to an appropriate extent in accordance with a linear pressure is used to suppress occurrence of the shear. According to this configuration, occurrence of the shear at the nip portion between the rollers is suppressed, so that longer life of the members, suppression of power consumption, and prevention of image distortion can be achieved. The extent of reducing the diameter of intermediate transfer member 15 is determined with use of, for example, the following method.

Figure 8:
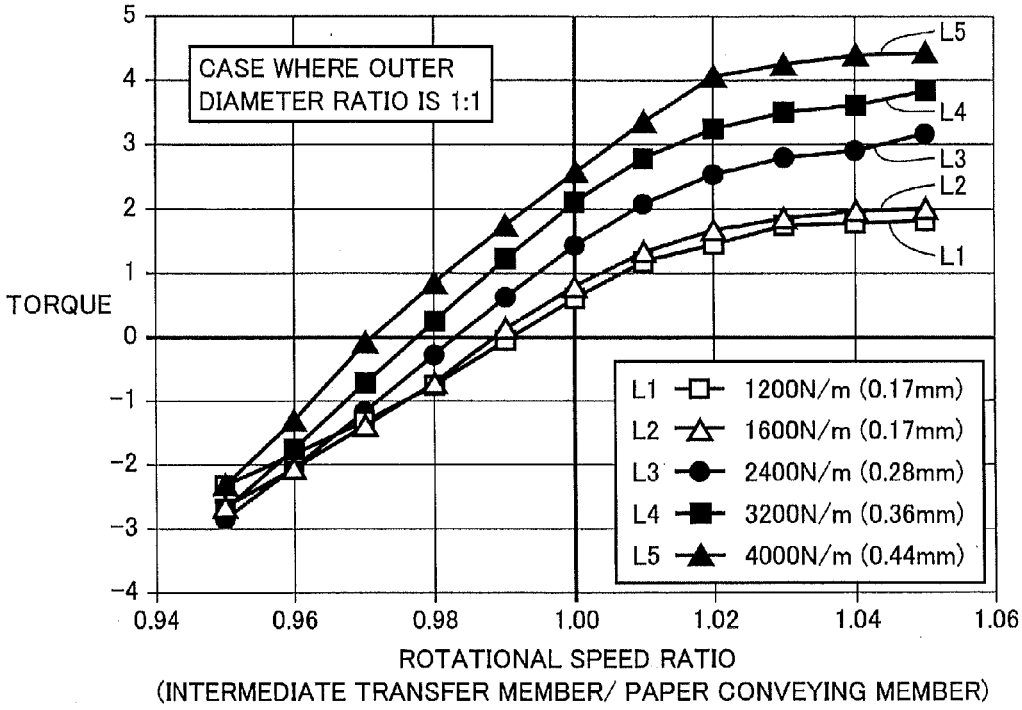
FIG. 8 represents, as to the first embodiment, how driving torque applied to driving of the paper conveying member is changed with respect to a rotational speed ratio between the intermediate transfer member and the paper conveying member when a linear pressure (or a push-in amount) with respect to the intermediate transfer member of the paper conveying member is changed.

FIG. 8 represents how driving torque exerted to driving of paper conveying member 17 is changed with respect to a rotational speed ratio between intermediate transfer member 15 and paper conveying member 17 when a linear pressure (or push-in amount) of paper conveying member 17 with respect to intermediate transfer member 15 is changed. In the explanatory example shown in FIG. 8, the linear pressure of paper conveying member 17 with respect to intermediate transfer member 15 is described with the unit N/m, and the push-in amount of paper conveying member 17 with respect to intermediate transfer member 15 is described with the unit mm.

As to the lines L1-L5 shown in FIG. 8, outer diameter D15 of intermediate transfer member 15 including elastic layer 15B and the outer diameter of paper conveying member 17 including recording paper 10P are set so as to have the same value. To exclude influence of torque applied to paper conveying member 17 from delivery members 19A, 19B, delivery members 19A, 19B and paper conveying member 17 are not in contact with each other. As to the torque represented by the vertical axis in FIG. 8, a positive value indicates torque in the direction of applying force in the driving direction of paper conveying member 17, and a negative value indicates torque in the direction of applying force in the driving direction and the reversed direction of paper conveying member 17.

As can be read from the lines L1-L5 in FIG. 8, it can be found that, as the push-in amount (or linear pressure) as the axes distance increases (the change from line L1 to line L5), the rotational ratio for obtaining zero torque (in other words, the rotational speed ratio when no shear occurs) deviates in the direction away from the rotational speed ratio 1. The deviation of the rotational speed ratio for obtaining zero torque (the state where additional torque is zero) is caused by the fact that the effective driving diameter of intermediate transfer member 15 increases with an increase in the push-in amount and that the surface speed of intermediate transfer member 15 and the surface speed of paper conveying member 17 do not match if the rotational speed of intermediate transfer member 15 is not set to have a lower value.

Figure 9:
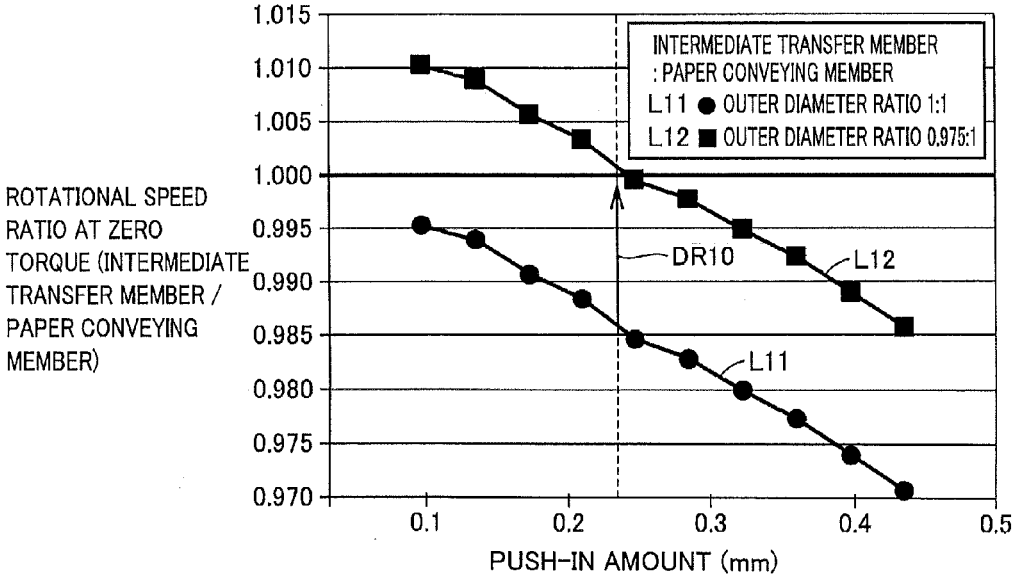
FIG. 9 represents, as to the first embodiment, a graph having a horizontal axis corresponding to a push-in amount (axes distance) with respect to the intermediate transfer member of the paper conveying member and a vertical axis corresponding to a rotational speed ratio rendering torque to be zero, based on FIG. 8.

FIG. 9 represents a graph having a horizontal axis corresponding to a push-in amount (axes distance) with respect to intermediate transfer member 15 of paper conveying member 17 and a vertical axis corresponding to a rotational speed ratio rendering the torque to be zero (the point where each of lines L1-L5 of FIG. 8 intersects with the axis of zero torque), based on FIG. 8. Line L11 in FIG. 9 shows the case where an outer diameter ratio between intermediate transfer member 15 and paper conveying member 17 is set to be 1:1, and line L12 shows the case where the outer diameter ratio between intermediate transfer member 15 and paper conveying member 17 is set to be 0.975:1.

As described above, in the configuration of using intermediate transfer member 15 having sheet-like elastic layer 15B on its surface and paper conveying member 17 having gripper 18, intermediate transfer member 15 and paper conveying member 17 are synchronized to have the same rotational speed (equal angular speed). During image forming, intermediate transfer member 15 and paper conveying member 17 are used at the rotational speed ratio 1. As can be understood from line L11 in FIG. 9, in the case where it is assumed that a certain push-in amount (for example, the linear pressure is 2000 N/m) is set, setting the outer diameter ratio between intermediate transfer member 15 and paper conveying member 17 to be 1:1 makes it difficult to obtain zero torque, in other words, avoid the shear at the secondary transfer nip.

On the other hand, as can be understood from line L12 in FIG. 9, when the outer diameter ratio between intermediate transfer member 15 and paper conveying member 17 is set to be 0.975:1 (the case where the outer diameter of intermediate transfer member 15 is set to be slightly smaller as compared to paper conveying member 17), the shift of line L11 is raised to the shift of line L12 (refer to arrow DR10), so that zero torque can be obtained, in other words, occurrence of the shear at the secondary transfer nip can be avoided at the linear pressure of 2000 N/m.

As described above, the thickness of recording paper 10P is changed in accordance with a type of paper to be used. When determining an initial condition setting of the outer diameter of intermediate transfer member 15 with respect to the outer diameter of paper conveying member 17, it is preferable to consider the thickness of recording paper 10P which is used most in standard, and/or the case where the thinnest paper assumed is wound. It is preferable to have a configuration of determining a standard as an initial value in advance, and determining an extent of reduction in a diameter of intermediate transfer member 15 and selecting elastic layer 15B having an appropriate thickness so that a sum of the driving torque of paper conveying member 17 and intermediate transfer member 15 during actual use is a minimum value (value smaller than a target set value).

(Axes Distance Adjustment Flow ST100)

A change in the effective diameter of paper conveying member 17 may become a factor causing a shear to occur at the nip portion (nip portion 17T in FIG. 5). In image forming apparatus 100 of the present embodiment, upon considering an average value (central value), a minimum value, or the like of the thickness of recording paper 10P assumed to be used, a diameter of intermediate transfer member 15 is set smaller appropriately so that the shear does not occur, and axes distance adjustment flow ST100 (push-in amount adjusting method) as described in the following is further conducted.

Figure 10:
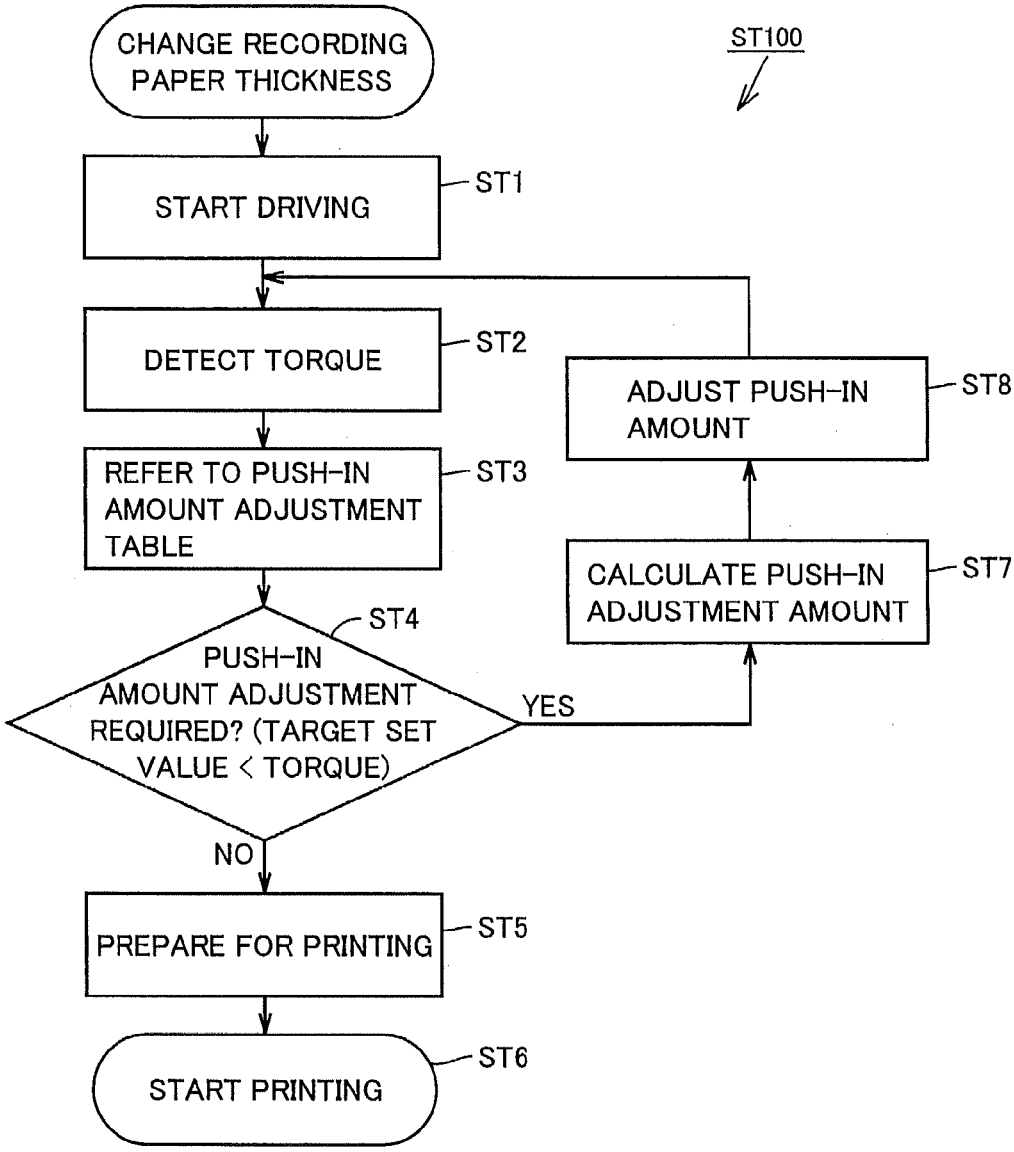
FIG. 10 represents an axes distance adjustment flow performed in the image forming apparatus according to the first embodiment.
Figure 11:
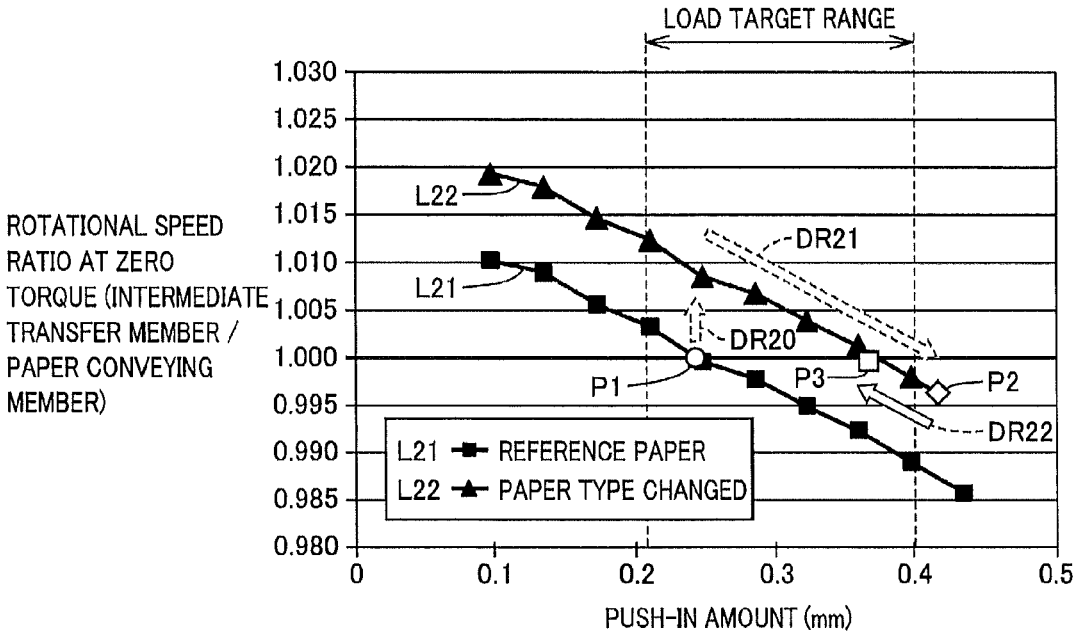
FIG. 11 represents, as to the first embodiment, a graph having a horizontal axis corresponding to a push-in amount (axes distance) with respect to the intermediate transfer member of the paper conveying member and a vertical axis corresponding to a rotational speed ratio rendering torque to be zero for both of the case of reference paper assumed to have an initial value and the case where a type of paper is changed during use.

FIG. 10 represents axes distance adjustment flow ST100 conducted in image forming apparatus 100. FIG. 11 represents a graph, for both of the case of reference paper assumed to have an initial value (line L21) and the case where the type of paper is changed during use (here, the case where the thickness of paper increases) (line L22), having the horizontal axis corresponding to a linear pressure of paper conveying member 17 with respect to intermediate transfer member 15 and the vertical axis corresponding to a rotational speed ratio rendering the torque to be zero.

After the thickness of recording paper 10P is changed, driving of intermediate transfer member 15 and paper conveying member 17 is started respectively (ST1 in FIG. 10). Intermediate transfer member 15 and paper conveying member 17 are driven so as to rotate at the same rotational speed. Torque detecting device 41 (refer to FIG. 7) is used to detect driving torque of paper conveying member 17 and/or intermediate transfer member 15 (ST2 in FIG. 10) while allowing recording paper 10P changed in the thickness to pass.

In the case where torque detecting device 41 detects driving torque of paper conveying member 17, torque detecting device 41 may be provided between paper conveying member 17 and paper conveying member driving device 17V to directly measure the driving torque of paper conveying member 17, or may refer to the used power amount of paper conveying member 17 to indirectly measure the driving torque of paper conveying member 17. This similarly applies to the case where torque detecting device 41 detects the driving torque of intermediate transfer member 15.

In the case where the thickness of recording paper 10P becomes larger, a substantive outer diameter ratio between intermediate transfer member 15 and paper conveying member 17 taking in consideration the thickness of recording paper 10P to be conveyed is changed, so that the rotational speed ratio at zero torque with respect to the push-in amount is changed as indicated by arrow DR20 heading upward from a point P1 in FIG. 11. Before and after the thickness of recording paper 10P becomes larger, if the axes distance between intermediate transfer member 15 and paper conveying member 17 is set to remain the same, the push-in amount increases as indicated by arrow DR21 toward lower right side on line L22, so that the rotational speed ratio rendering the torque to be zero is changed. Before and after the thickness of recording paper 10P becomes larger, if the axes distance between intermediate transfer member 15 and paper conveying member 17 is set to remain the same, the relationship between intermediate transfer member 15 and paper conveying member 17 is shifted to a point P2 in FIG. 11. The rotational speed ratio rendering the torque to be zero is deviated from the rotational speed ratio 1.

In the present embodiment, a push-in amount adjustment table is referred (ST3 in FIG. 10) based on the detection result of torque detecting device 41. The push-in amount adjustment table is data prepared in advance, and is a database containing information as to which push-in amount should be set for each type (paper thickness) of recording paper 10P to achieve the zero torque. Based on the detection result of torque detecting device 41, it is determined whether or not the adjustment of the push-in amount is necessary (ST4 in FIG. 10).

Whether or not the adjustment of the push-in amount is necessary is determined based on whether or not a sum of the driving torque of paper conveying member 17 and intermediate transfer member 15 is smaller than a target set value. For this determination, only the driving torque (first driving torque) of intermediate transfer member 15 may be detected to determine whether or not the driving torque of intermediate transfer member 15 is smaller than the predetermined set value, or only the driving torque (second driving torque) of paper conveying member 17 may be detected to determine whether or not the driving torque of paper conveying member 17 is smaller than the predetermined set value, or both the driving torque (first driving torque) of intermediate transfer member 15 and the driving torque (second driving torque) of paper conveying member 17 may be detected to determine whether or not a sum of the torque is smaller than the target set value.

During image forming, in the case where the torque received by paper conveying member 17 from delivery members 19A, 19B affects the torque measurement performed by torque detecting device 41, the driving torque of intermediate transfer member 15 and paper conveying member 17 can be obtained by obtaining in advance the torque received by paper conveying member 17 from delivery members 19A, 19B and subtracting the value from the torque measurement result. Similarly in the case where torque other than the torque received by paper conveying member 17 from delivery members 19A, 19B occurs, the driving torque of intermediate transfer member 15 and paper conveying member 17 can be obtained by obtaining the torque in advance and subtracting the value from the torque measurement result.

In the case where it is determined that the adjustment of the push-in amount is not necessary, the process proceeds to the preparation for printing (ST5 in FIG. 10), and then normal printing is started (ST6 in FIG. 10). On the other hand, in the case where the torque value detected by torque detecting device 41 exceeds the target set value, and it is determined that the adjustment of the push-in amount is necessary, a required push-in adjustment amount is calculated (or selected) based on the data of the table (ST7 in FIG. 10).

After the required push-in adjustment amount is obtained, adjusting device 20 is operated, and the push-in amount of paper conveying member 17 with respect to intermediate transfer member 15 (axes distance between the rotational axis of intermediate transfer member 15 and the rotational axis of paper conveying member 17) is adjusted (ST8 in FIG. 10). After that, again, torque detecting device 41 (refer to FIG. 7) is used to detect the driving torque of intermediate transfer member 15 and/or paper conveying member 17 (ST2 in FIG. 10), and the flow as described above is repeated. Without using the database for adjustment of the push-in amount, the flow of changing the push-in amount by a predetermined fine stepped portions, changing the push-in amount toward an appropriate direction based on positive and negative of the torque detection result, and performing torque detection again may be repeatedly performed to change the push-in amount until a desired state of zero torque (or the state close to zero torque) is achieved.

Figure 12:
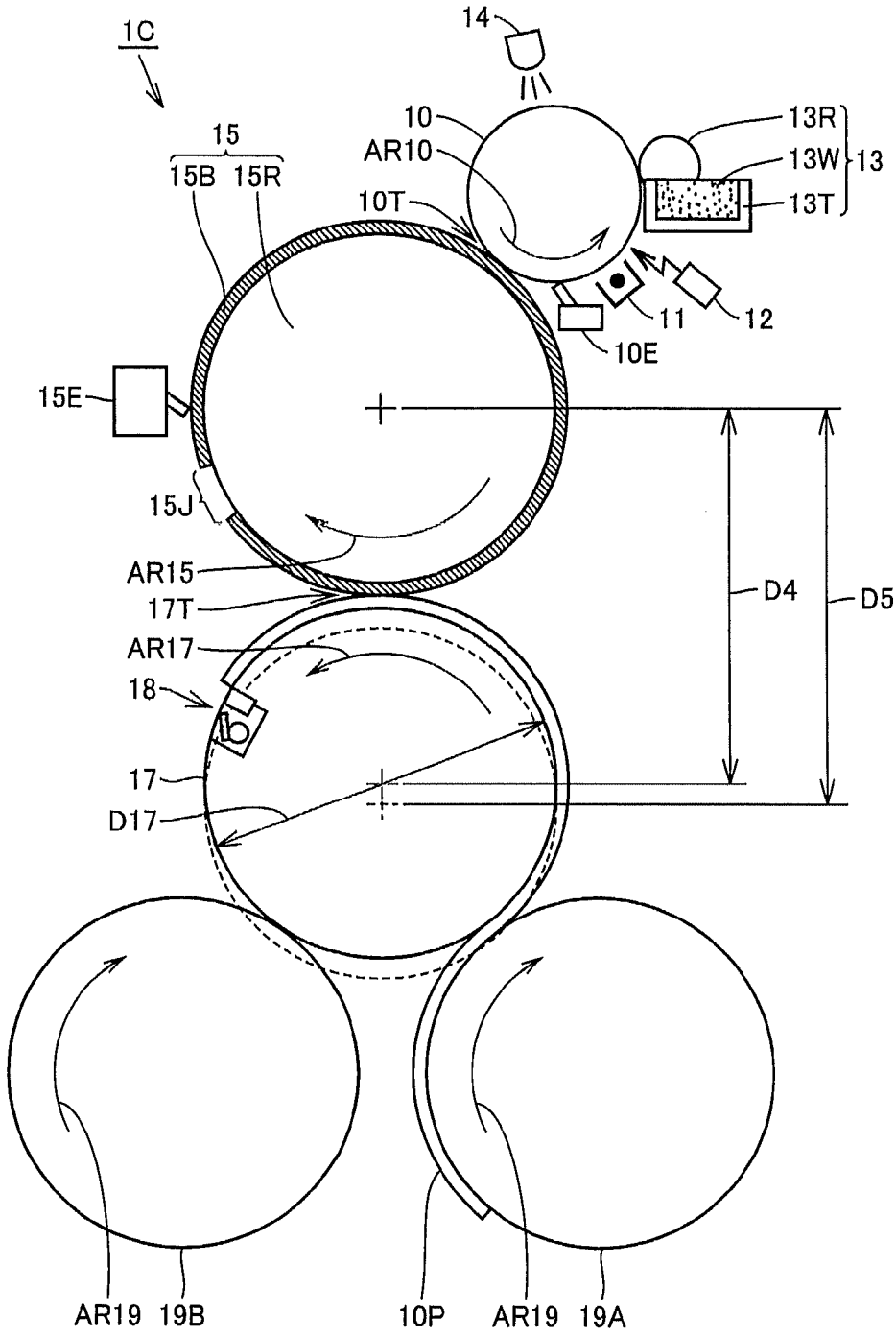
FIG. 12 represents appearance after an axes distance between the paper conveying member and the intermediate transfer member is adjusted in the image forming apparatus of the first embodiment.

Referring to FIG. 12, by conducting the determination and axes distance adjustment as described above, axes distance D4 as an initial value is changed to an axes distance D5, so that the push-in amount (or linear pressure) of paper conveying member 17 with respect to intermediate transfer member 15 is adjusted appropriately. The relationship between intermediate transfer member 15 and paper conveying member 17 is shifted from point P2 to point P3 as indicated by arrow DR22 in FIG. 11, so that the zero torque can be obtained, in other words, occurrence of the shear at the secondary transfer nip can be avoided with the linear pressure of, for example, 2000 N/m.

As described above, adjusting device 20 in image forming apparatus 100 adjusts the axes distance between intermediate transfer member 15 and paper conveying member 17 in accordance with a thickness of recording paper 10P passing through intermediate transfer member 15 and paper conveying member 17 so that a sum of the first driving torque for rotating intermediate transfer member 15 at the first rotational speed and the second driving torque for rotating paper conveying member 17 at the second rotational speed becomes smaller than a target set value.

Therefore, according to image forming apparatus 100, even in the case where the thickness of recording paper 10P is changed, the same surface speed between intermediate transfer member 15 and paper conveying member 17 (recording paper 10P) can be secured without changing the rotational speed ratio between intermediate transfer member 15 and paper conveying member 17 arranged opposite to each other. Accordingly, occurrence of the shear can be suppressed. The rotation of seam 15J on intermediate transfer member 15 and the rotation of gripper 18 provided in paper conveying member 17 are synchronized to have the same rotational speed (same angular speed), so that both improvement of accuracy in conveying paper and widening of the image forming width can be achieved.

As described above, image forming apparatus 100 in the present embodiment is a so-called wet-type image forming apparatus, and uses a liquid developer containing toner dispersed in carrier liquid to form an image. As compared to the method without use of toner such as offset printing and inkjet, in the electrographic method using toner, a toner image is transferred to recording paper and the like at the nip portion formed between an intermediate transfer member (image bearing body) and a paper conveying member. When the shear occurs between the intermediate transfer member and the recording paper, the toner may be deformed due to stress, and the phenomenon of allowing toner to adhere to the surface of the intermediate transfer member (filming) is likely to occur.

In the wet-type electrographic method as employed in image forming apparatus 100, toner is moved in the carrier liquid held between the image bearing body and the paper conveying member, so that a toner image can be transferred onto the recording paper. To secure a time necessary for moving toner, not only allowing the image bearing body and the paper conveying member to be come in contact with each other but also securing a predetermined nip width between the image bearing body and the paper conveying member is necessary. In the wet-type electrographic method, a thickness of an elastic layer provided in the intermediate transfer member tends to be greater as compared to other methods. Therefore, the shear is more likely to occur between the intermediate transfer member and the recording paper.

Further, in the transfer process of the wet-type electrographic method where recording paper and the intermediate transfer member are in close contact with each other, and a space formed therebetween is connected with the liquid developer to transfer a toner image, an intermediate transfer member having a lower surface rigidity as compared to a dry-type electrographic method is used, and a pressure during the transfer to recording paper 10P is set to be higher as compared to the dry-type electrographic method. Therefore, deterioration of the intermediate transfer member should be particularly concerned in the wet-type electrographic method.

On the other hand, according to image forming apparatus 100 of the present embodiment, occurrence of the shear between the surface of recording paper 10P and the surface of intermediate transfer member 15 is suppressed by the axes distance adjustment (adjustment of push-in amount) between intermediate transfer member 15 and paper conveying member 17, so that wearing of the members, an increase in power consumption due to rise in driving torque, distortion of an image, or the like can also be suppressed effectively.

FIRST MODIFIED EXAMPLE

In axes distance adjustment flow ST100 (refer to FIG. 10) of the first embodiment described above, after the push-in amount of paper conveying member 17 with respect to intermediate transfer member 15 is adjusted (after ST8), torque detecting device 41 (refer to FIG. 7) is used to detect again the driving torque of intermediate transfer member 15 and/or paper conveying member 17 (ST2 in FIG. 10).

Figure 13:
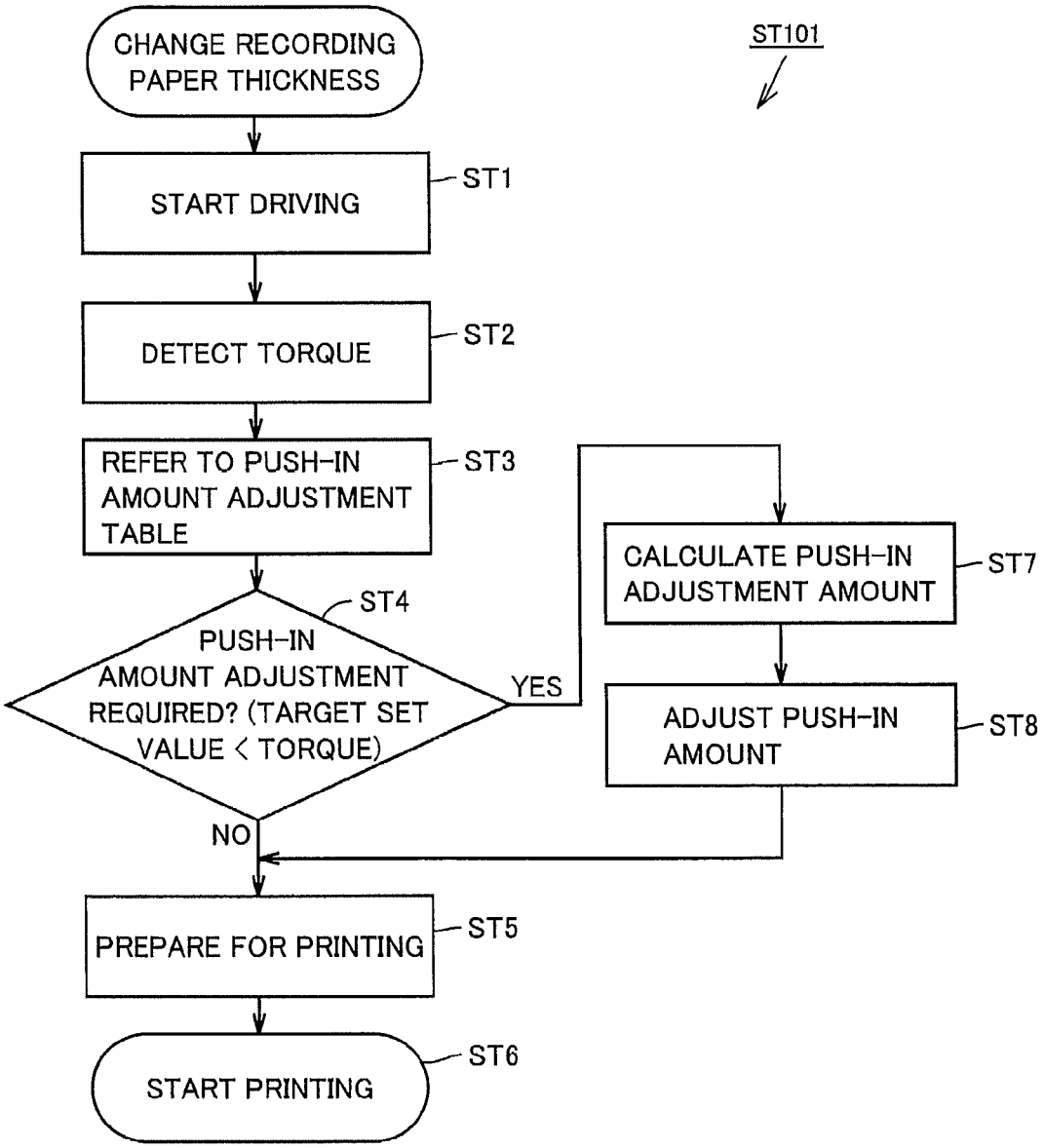
FIG. 13 represents an axes distance adjusting flow performed in an image forming apparatus of a first modified example according to the first embodiment.

As can be seen in an axes distance adjustment flow ST101 shown in FIG. 13, after the push-in amount of paper conveying member 17 with respect to intermediate transfer member 15 is adjusted, the process may proceed to preparation for printing (ST5 in FIG. 11), and normal printing may be started (ST6 in FIG. 11).

SECOND MODIFIED EXAMPLE

In the first embodiment described above, intermediate transfer member 15 and paper conveying member 17 have substantially the same outer diameter (more specifically, intermediate transfer member 15 has an outer diameter slightly smaller than an outer diameter of paper conveying member 17), and intermediate transfer member 15 is driven to rotate at the first rotational speed, and paper conveying member 17 is driven to rotate at the second rotational speed. The first rotational speed and the second rotational speed have the same value.

As described above, a circumferential length of intermediate transfer member 15 and a circumferential length of paper conveying member 17 are set to have a length not less than about one sheet (or its integer multiple) of paper size covered by image forming apparatus 100. Therefore, an outer diameter ratio between intermediate transfer member 15 and paper conveying member 17 may be configured to have a ratio of about 2:1, or may be configured to have a ratio of about 1:2.

In the case where the outer diameter ratio between intermediate transfer member 15 and paper conveying member 17 is configured to be about 2:1, the first rotational speed and the second rotational speed are set to have values with a ratio of 1:2. In this case, it is preferable to provide two grippers 18 on paper conveying member 17. In the case where the outer diameter ratio between intermediate transfer member 15 and paper conveying member 17 is configured to be about 1:2, the first rotational speed and the second rotational speed are set to have values with a ratio of 2:1.

Even in the case where one of the first rotational speed and the second rotational speed is set such that one value is an integer multiple of the other value in accordance with an outer diameter ratio of intermediate transfer member 15 and paper conveying member 17, axes distance adjustment flows ST100, ST101 are applied, so that the occurrence of the shear is suppressed to achieve fine transfer and form an image exhibiting a high quality.

THIRD MODIFIED EXAMPLE

In the first embodiment described above, elastic layer 15B is provided only on the outer peripheral surface of intermediate transfer member 15. With regard to this configuration, the elastic layer may be provided only on the outer peripheral surface of paper conveying member 17, or the elastic layer may be provided on both the outer peripheral surface of intermediate transfer member 15 and the outer peripheral surface of paper conveying member 17.

By applying axes distance adjustment flow ST100, ST101 described above, even in the case where the thickness of recording paper 10P is changed, the same surface speed between intermediate transfer member 15 and paper conveying member 17 (recording paper 10P) can be secured without changing a rotational speed between intermediate transfer member 15 and paper conveying member 17 arranged opposite to each other. Accordingly, occurrence of the shear can be suppressed.

FOURTH MODIFIED EXAMPLE

In the first embodiment described above, intermediate transfer member 15 having elastic layer 15B formed on the surface is used as an image bearing body. Intermediate transfer member 15 is preferably used as needed. In the case where intermediate transfer member 15 is not used, photoconductor 10 serves as an image bearing body, and an elastic layer is provided on an outer peripheral surface of paper conveying member 17, and paper conveying member 17 is arranged so as to be in press-contact with photoconductor 10. Even with this configuration, even in the case where axes distance adjustment flows ST100, ST101 are applied to change the thickness of recording paper 10P, the same surface speed can be secured between photoconductor 10 and paper conveying member 17 (recording paper 10P) without changing the rotational speed ratio between photoconductor 10 and paper conveying member 17 arranged opposite to each other. Accordingly, occurrence of the shear can be suppressed.

FIFTH MODIFIED EXAMPLE

In image forming apparatus 100 of the first embodiment described above, intermediate transfer member 15 and paper conveying member 17 rotate in synchronism, so that the rotation of gripper 18 and the rotation of seam 15J are synchronized. The present invention can be applied to the configuration having paper conveying member 17 not provided with gripper 18 and intermediate transfer member 15 not provided with seam 15J. By the rotation of intermediate transfer member 15 and paper conveying member 17 in synchronism, not only the effect of suppressing occurrence of the shear but also the following effect can be obtained.

There exists some variation (physical bias formed during production) between an image bearing body such as intermediate transfer member 15 and paper conveying member 17, and this variation may become an unstable factor (cycle unevenness and the like) of an image. By setting paper conveying member 17 and intermediate transfer member 15 to have substantially the same diameter, and maintaining the same rotational speed, a position of unevenness generated due to the variation does not change for each image forming, and the unevenness is generated at the same location with a constant extent. When a difference is made in the rotational speeds between paper conveying member 17 and intermediate transfer member 15 (rotational speed is made different from integer multiples), the unevenness to be generated is changed by time in accordance with combination of locations of the deviation of both rollers. Therefore, it becomes difficult to specify the position of the unevenness to be generated.

If the unevenness is generated to a constant extent always at the same location, the generation of the unevenness can be predicted to some extent. By rotating intermediate transfer member 15 and paper conveying member 17 in synchronism, the location and the extent of the unevenness can be detected periodically, and by providing a feedback to the image forming unit (in the case of electrographic method, correct depiction data to the photoconductor), occurrence of the unevenness can be reduced.

Additionally, the intermediate transfer member having an elastic layer on its surface may have a damage on its surface by formation of fine deformation due to fatigue caused by repeated contact of the end portion of the recording paper, and by formation of dent due to sudden collision from outside. This damage affects image quality as an image noise. By setting the paper conveying member and the intermediate transfer member to have the same diameter to always have the same rotational speed, and by adjusting the synchronizing position to allow the position of the damage to be moved to a position between paper sheets on the paper conveying member, a damage satisfying a certain condition can be avoided from giving an effect on an image on paper, and the frequency of replacing the rollers can be avoided.

[Second Embodiment]

Figure 14:
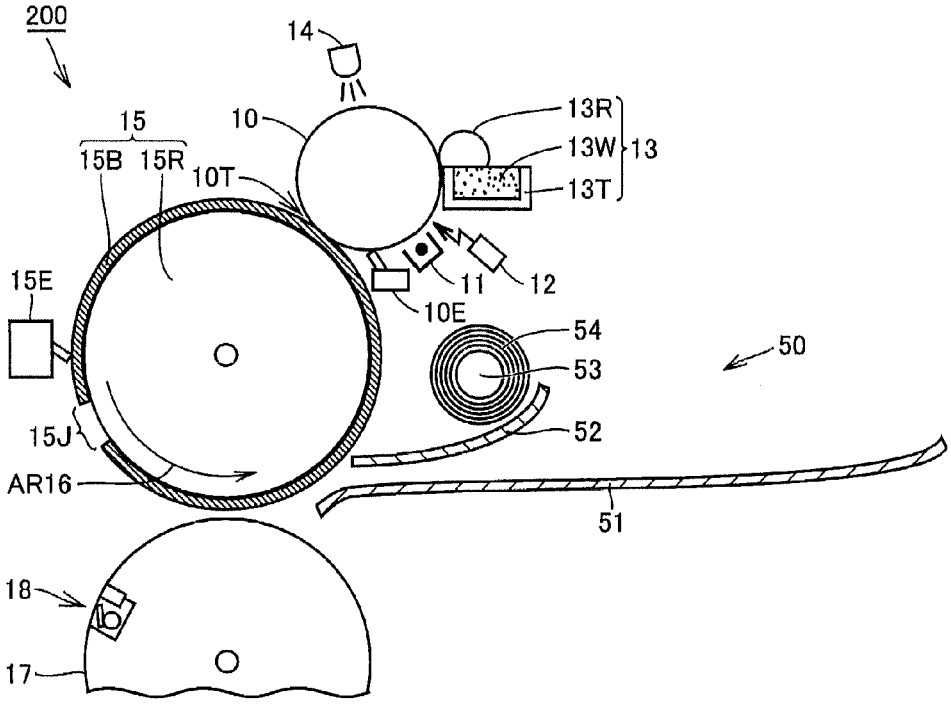
FIG. 14 represents an image forming apparatus according to a second embodiment.
Figure 15:
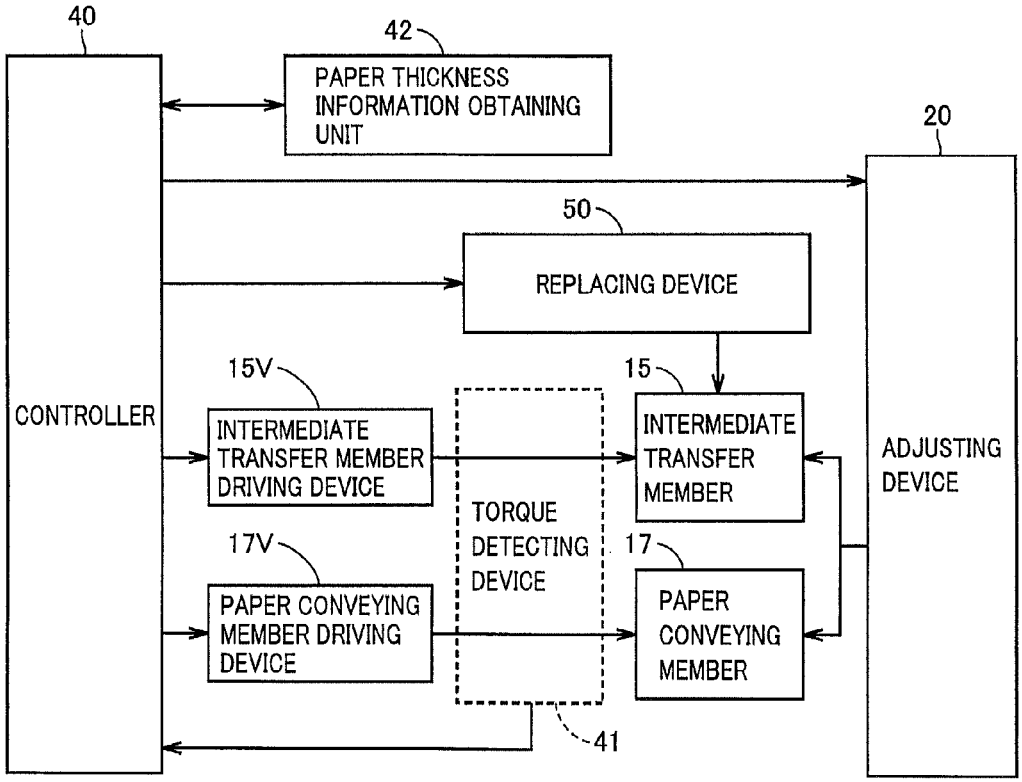
FIG. 15 represents control blocks of the image forming apparatus according to the second embodiment.

Referring to FIGS. 14 and 15, image forming apparatus 200 according to the present embodiment will be described. Image forming apparatus 200 further includes a replacing device 50 and a paper thickness information obtaining unit 42. Replacing device 50 replaces elastic layer 15B provided on an outer peripheral surface of intermediate transfer member 15 with another elastic layer 15B having a thickness different from that of elastic layer 15B. Replacing device 50 of the present embodiment winds an adjustment sheet 54 on a surface (under elastic layer 15B) of base member 15R so that adjustment sheet 54 and the original elastic layer 15B wound around the surface of adjustment sheet 54 is set to be "another elastic layer" having a thickness different from that of original elastic layer 15B.

Paper thickness information obtaining unit 42 obtains paper thickness information of recording paper 10P used for image forming. Paper thickness information obtaining unit 42 obtains information related to the thickness of recording paper 10P based on, for example, a signal inputted by an operator through an operation panel not illustrated in the drawings. Paper thickness information obtaining unit 42 may be provided with an ultrasonic sensor for measuring a thickness of recording paper 10P on a conveyance passage for recording paper 10P, and configured to obtain information related to the thickness of recording paper 10P from this sensor. Paper thickness information obtaining unit 42 may be provided with a pair of conveyance rollers on the conveyance passage for recording paper 10P, further provided with a sensor for measuring an axes distance between the pair of conveyance rollers, and configured to obtain information related to a thickness of recording paper 10P based on the axes distance between the pair of conveyance rollers measured by the sensor when recording paper 10P passes through the nip portion formed between the pair of conveyance rollers.

In image forming apparatus 100 according to the first embodiment described above, axes distance adjustment flow ST100 is executed to drive adjusting device 20, and the push-in amount (or linear pressure) of paper conveying member 17 with respect to intermediate transfer member 15 is adjusted. In the case where the push-in amount (axes distance) and the driving torque can be adjusted by adjustment of axes distance by adjusting device 20 so that the linear pressure at the nip portion between intermediate transfer member 15 and paper conveying member 17 is set within an allowable range on account of quality, only the adjustment of the axes distance may be conducted. On the other hand, applying only the adjustment of axes distance causes the push-in amount (linear pressure) to be larger, leading to the case of being difficult to correspond to the change of the paper thickness assumed for use as recording paper 10P.

Figure 16:
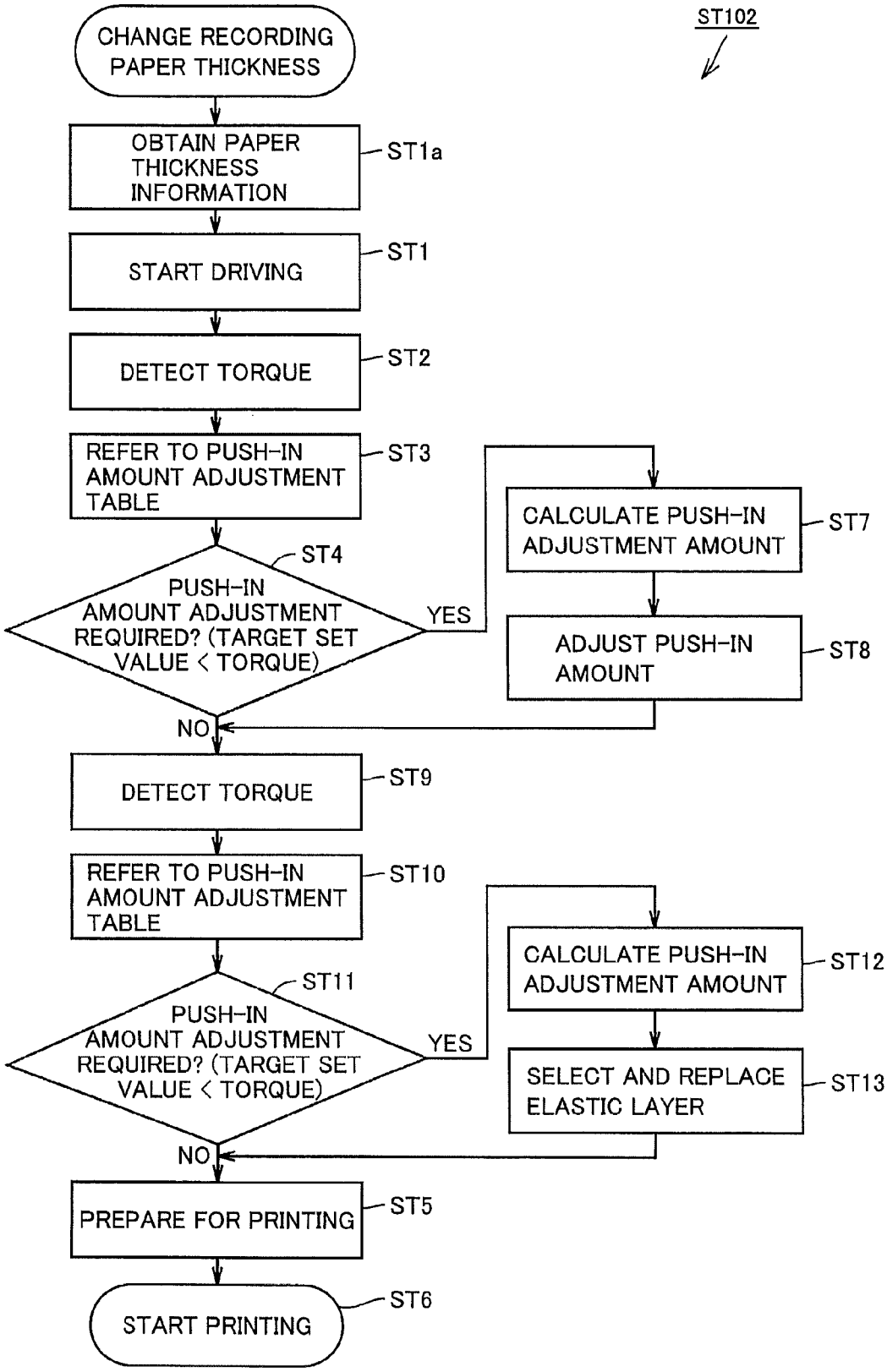
FIG. 16 represents an axes distance adjustment flow performed in the image forming apparatus according to the second embodiment.

Therefore, in the present embodiment, controller 40 obtains the information related to the paper thickness of recording paper 10P used for image forming. Controller 40 determines whether or not a push-in amount (linear pressure) at an axes distance adjustment value estimated by the adjustment of axes distance or a push-in amount (linear pressure) at an axes distance adjustment value after adjustment actually conducted as will be shown in the flow of FIG. 16 is within an appropriate linear pressure range, based on the obtained paper thickness information of recording paper 10P (determination on whether or not elastic layer 15B should be replaced with the one having a different thickness). In the case where it is determined that replacement is required, controller 40 controls driving of replacing device 50 to replace original elastic layer 15B with another elastic layer having an appropriate thickness.

According to image forming apparatus 200 of the present embodiment, replacing device 50 changes an outer diameter of intermediate transfer member 15. Specifically, replacing device 50 includes a accommodating tray 51, a guide 52, a shaft member 53, and an adjustment sheet 54. Accommodating tray 51 has a length substantially the same as elastic layer 15B, and elastic layer 15B can be mounted on its surface. Guide 52 is arranged above accommodating tray 51 and provided so as to slope toward intermediate transfer member 15. Shaft member 53 is arranged above guide 52, and adjustment sheet 54 is wound around shaft member 53.

Referring to FIG. 15, controller 40 controls driving of replacing device 50 based on information received from torque detecting device 41 and information as to recording paper 10P received from paper thickness information obtaining unit 42, and replaces elastic layer 15B provided on the outer peripheral surface of intermediate transfer member 15 with another elastic layer 15B having a thickness different from that of this elastic layer 15B. In the present embodiment, replacing device 50 selects adjustment sheet 54 having a required thickness and supplies it to the surface (under elastic layer 15B) of base member 15R.

(Axes Distance Adjustment Flow ST102)

Figure 17:
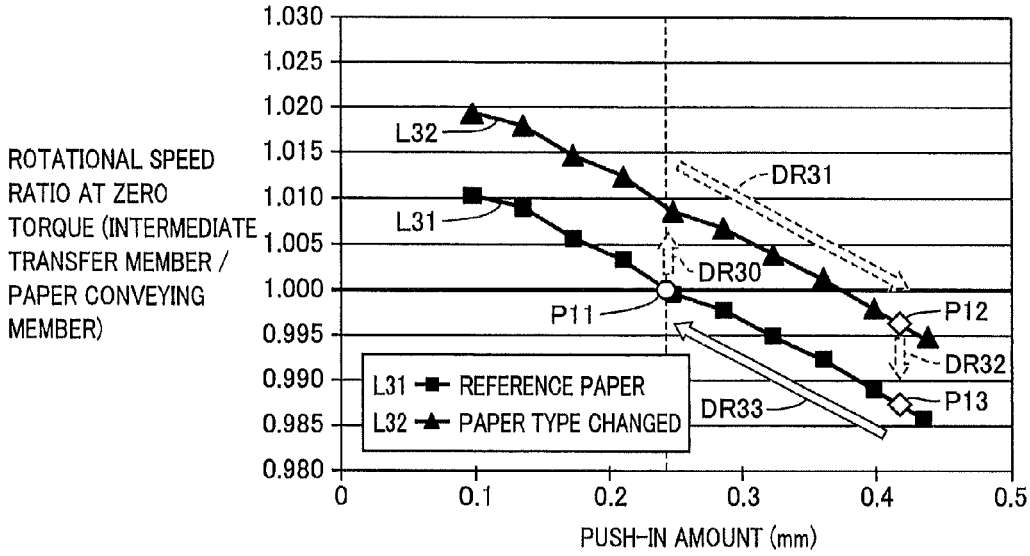
FIG. 17 represents, as to the second embodiment, a graph having a horizontal axis corresponding to a push-in amount (axes distance) with respect to the intermediate transfer member of the paper conveying member and a vertical axis corresponding to a rotational speed ratio rendering torque to be zero for both of the case of reference paper assumed to have an initial value and the case where a type of paper is changed during use.

FIG. 16 represents axes distance adjustment flow ST102 performed in image forming apparatus 200. FIG. 17 represents a graph having a horizontal axis corresponding to a push-in amount (axes distance) of paper conveying member 17 with respect to intermediate transfer member 15 and a vertical axis corresponding to a rotational speed ratio rendering the torque to be zero for both of the case of reference paper assumed to be an initial value (line L31) and the case where the type of paper is changed during use (here, the case where the paper thickness is increased).

Referring to FIG. 16, in axes distance adjustment flow ST102, paper thickness information related to recording paper 10P to be used is obtained from obtaining unit 42 (ST1*a*). After the axes distance adjustment is performed by adjusting device 20 (after ST8), torque detecting device 41 (refer to FIG. 15) is used to detect driving torque of paper conveying member 17 and/or intermediate transfer member 15 (ST9 in FIG. 16).

When the thickness of recording paper 10P becomes larger, an outer diameter ratio between intermediate transfer member 15 and paper conveying member 17 is changed, leading to a change in a rotational speed ratio of zero torque with respect to the push-in amount as indicated by arrow DR30 extending upward from point P11 in FIG. 17. If the axes distance between intermediate transfer member 15 and paper conveying member 17 remains the same before and after the thickness of recording paper 10P becomes larger, the push-in amount increases, and a rotational speed ratio of zero torque is changed as indicated by arrow DR31 toward lower right direction on line L32. If the axes distance between intermediate transfer member 15 and paper conveying member 17 remains the same before and after the thickness of recording paper 10P becomes larger, the relationship between intermediate transfer member 15 and paper conveying member 17 is shifted to point P12 of FIG. 17. The rotational speed ratio of zero torque is deviated from the point of rotational speed ratio 1.

In the present embodiment, in accordance with a substantial increase in an outer diameter of paper conveying member 17 including a paper thickness of recording paper due to change (here, increase) in the paper thickness of recording paper 10P, replacing device 50 replaces elastic layer 15B with thicker one. Replacement of the elastic layer causes an outer diameter of intermediate transfer member 15 to increase. As indicated by arrow DR32 in FIG. 17, the relationship between intermediate transfer member 15 and paper conveying member 17 shifts from point P12 to point P13 in FIG. 17, so that the outer diameter ratio between intermediate transfer member 15 and paper conveying member 17 can be set back to the relationship close to the initial setting. After that, based on the detection result of torque detecting device 41, another push-in amount adjustment table is referred (ST10 in FIG. 16). Based on the detection result of torque detecting device 41, it is determined whether or not adjustment of the push-in amount is necessary (ST11 in FIG. 16).

Whether or not the adjustment of the push-in amount (axes distance) is necessary is determined based on whether or not a sum of the driving torque of paper conveying member 17 and intermediate transfer member 15 is smaller than a target set value. For this determination, only the driving torque (first driving torque) of intermediate transfer member 15 may be detected to determine whether or not the driving torque of intermediate transfer member 15 is smaller than the predetermined set value, or only the driving torque (second driving torque) of paper conveying member 17 may be detected to determine whether or not the driving torque of paper conveying member 17 is smaller than the predetermined set value, or both the driving torque (first driving torque) of intermediate transfer member 15 and the driving torque (second driving torque) of paper conveying member 17 may be detected to determine whether or not a sum of the torque is smaller than the target set value.

In the case where it is determined that the adjustment of the push-in amount (axes distance) is not necessary, the process proceeds to preparation for printing (ST5 in FIG. 16), and normal printing is started (ST6 in FIG. 16). On the other hand, in the case where the driving torque detected by torque detecting device 41 exceeds the target set value, and it is determined that the adjustment of push-in amount (axes distance) is necessary, a required push-in adjustment amount (axes distance) is calculated (or selected) based on data of the table, and a linear pressure at the nip portion during conveyance of recording paper 10P is calculated based on the required push-in adjustment amount (axes distance) and the paper thickness information obtained in ST1*a* (ST12 in FIG. 16), and an elastic layer is selected based on the calculation result (ST 13). In the case where it is determined by the calculation that the linear pressure deviates from the allowable range on account of quality, the elastic layer is replaced with another elastic layer. Without using the database to adjust the push-in amount (axes distance), the push-in amount may be changed by repeatedly performing the flow of changing the push-in amount by certain fine stepped portions, changing the push-in amount in an appropriate direction based on the torque detection result, and performing the torque detection again until a desired zero torque state (or state close to zero torque) is obtained.

As indicated by arrows DR32, DR33 in FIG. 17, replacing device 50 and adjusting device 20 are used to set the push-in amount (or linear pressure) to be within an appropriate range, so that the relationship between intermediate transfer member 15 and paper conveying member 17 is shifted from point P12 to point P11 in FIG. 17. As described above, by executing axes distance adjustment flow ST102, the zero torque state can be obtained, in other words, occurrence of the shear at the secondary transfer nip can be prevented even when the change in the paper thickness assumed to be used as recording paper 10P is large.

Figure 18:
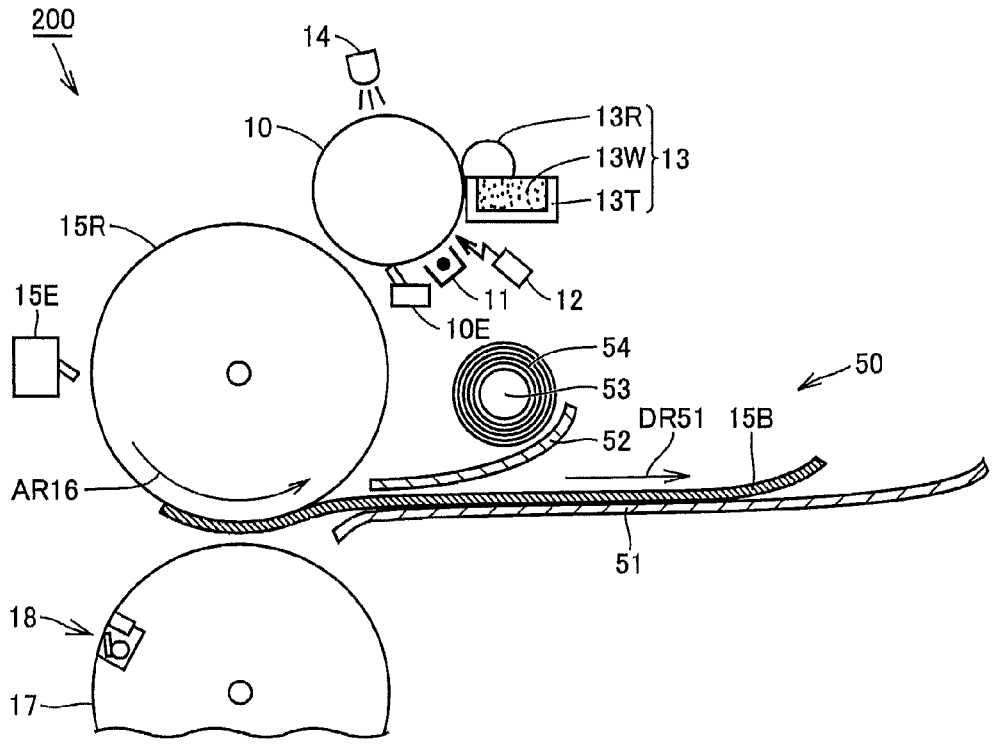
FIG. 18 is a first drawing representing, as to the second embodiment, appearance of replacing the elastic layer of the intermediate transfer member with use of a replacing device.

Referring to FIGS. 18-22, the operation of replacing elastic layer 15B with use of replacing device 50 is performed, for example, as follows. As shown in FIG. 18, base member 15R rotates in the direction of arrow AR16, and a chuck device which is not illustrated in the drawing detaches elastic layer 15B from base member 15R and guides it to accommodating tray 51 (refer to arrow DR51).

Figure 19:
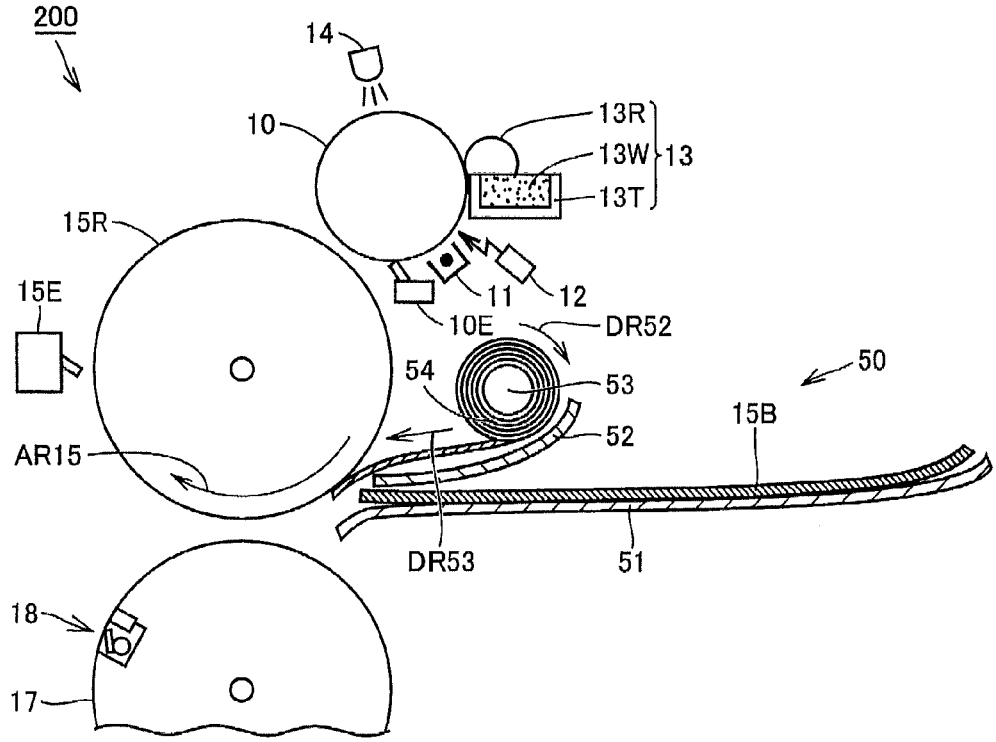
FIG. 19 is a second drawing representing, as to the second embodiment, appearance of replacing the elastic layer of the intermediate transfer member with use of a replacing device.

Referring to FIG. 19, after adjustment sheet 54 having an appropriate thickness is selected, shaft member 53 around which adjustment sheet 54 is wound rotates in the direction of arrow DR52. Adjustment sheet 54 is attached to the surface of base member 15R by the chuck device which is not illustrated in the drawing. Rotation of base member 15R in the direction of arrow AR15 allows adjustment sheet 54 to be gradually wound around the surface of base member 15R.

Figure 20:
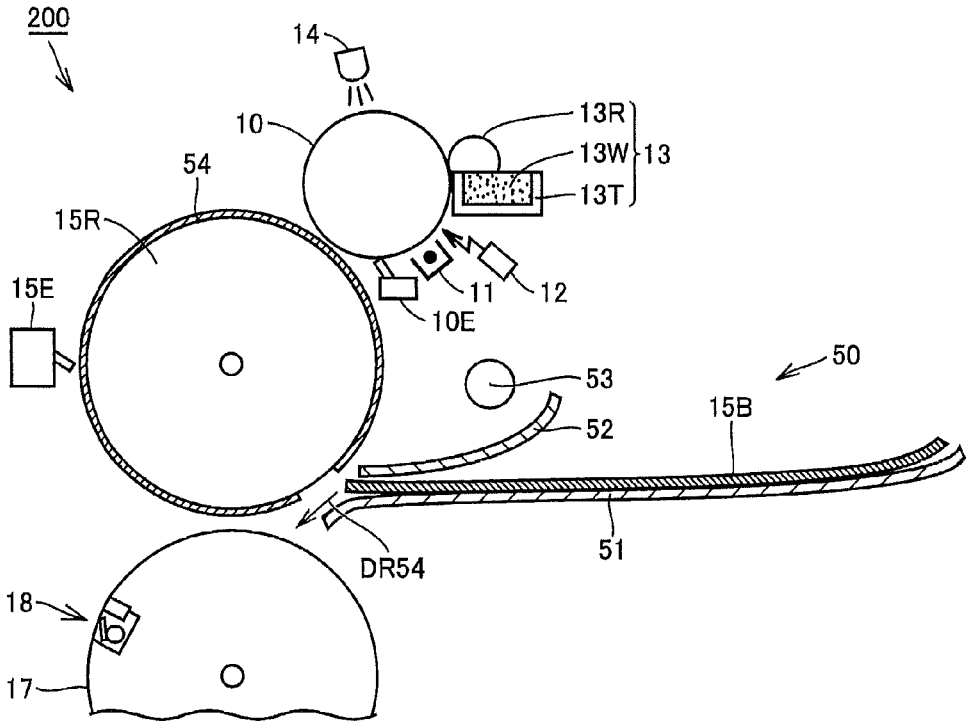
FIG. 20 is a third drawing representing, as to the second embodiment, appearance of replacing the elastic layer of the intermediate transfer member with use of a replacing device.
Figure 21:
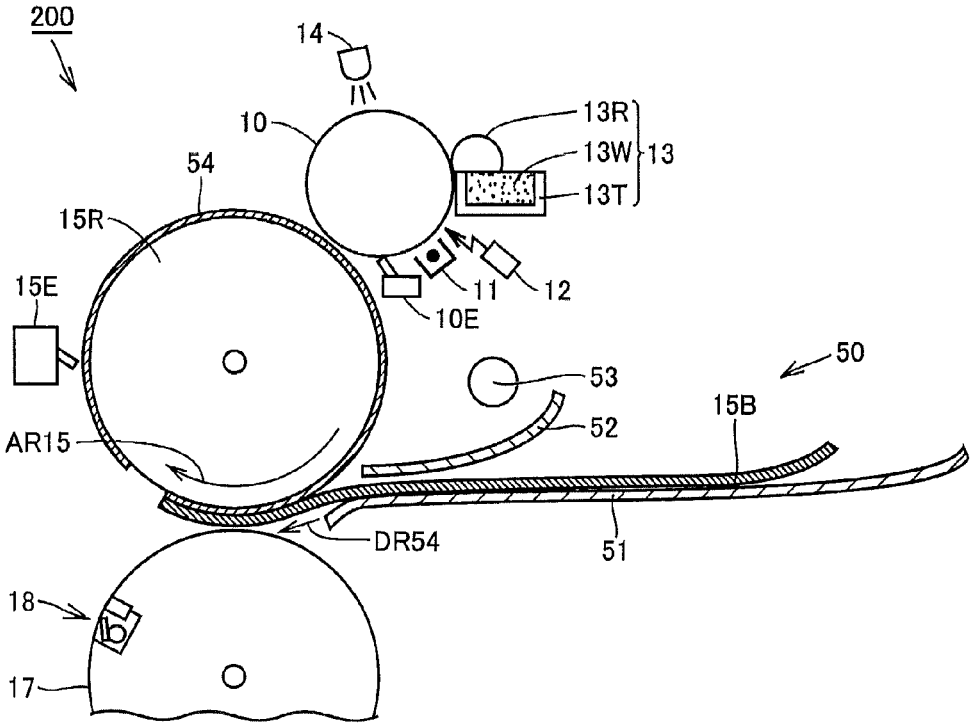
FIG. 21 is a fourth drawing representing, as to the second embodiment, appearance of replacing the elastic layer of the intermediate transfer member with use of a replacing device.

Referring to FIG. 20, after adjustment sheet 54 is wound around base member 15R, the chuck device which is not illustrated in the drawing attaches elastic layer 15B to the surface of adjustment sheet 54. As shown in FIG. 21, elastic layer 15B is sent to the direction indicated by arrow DR54, and base member 15R rotates in the direction of arrow AR15, so that elastic layer 15B is gradually wound around the surface of adjustment sheet 54.

Figure 22:
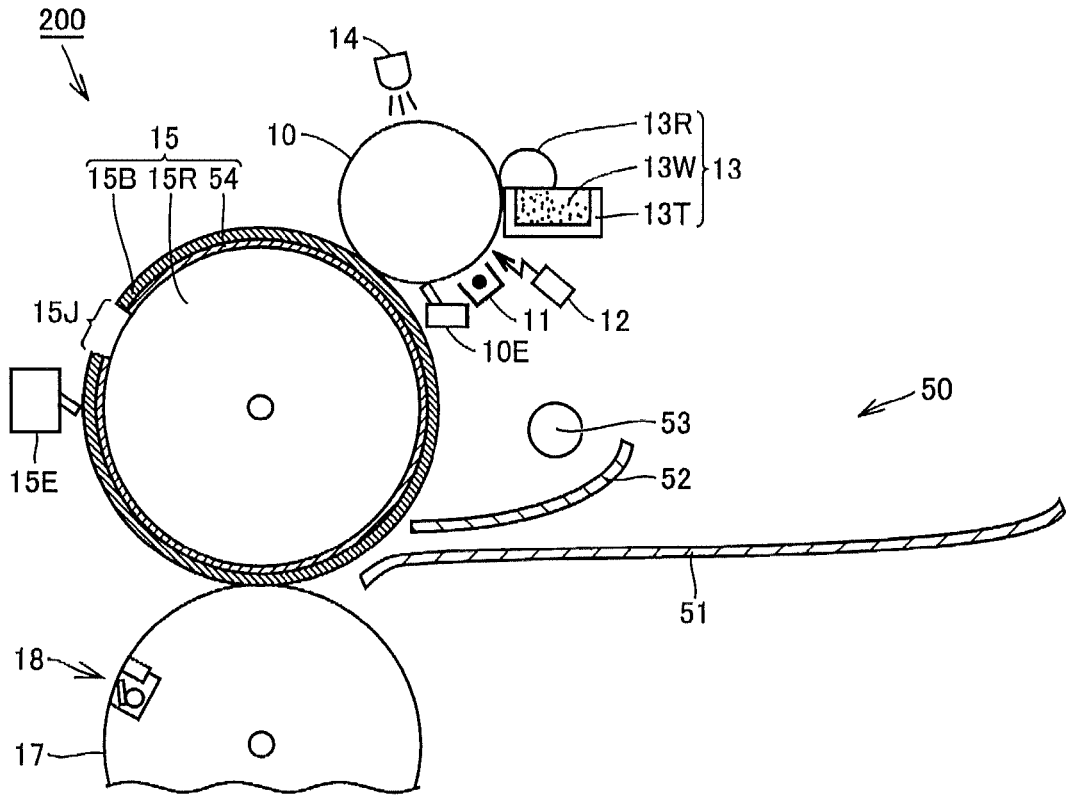
FIG. 22 is a fifth drawing representing, as to the second embodiment, appearance of replacing the elastic layer of the intermediate transfer member with use of a replacing device.

Referring to FIG. 22, elastic layer 15B is wound around the surface of adjustment sheet 54, so that intermediate transfer member 15 having elastic layer 15B, base member 15R, and adjustment sheet 54 is formed. In the present embodiment, elastic layer 15B is temporarily retreated to allow adjustment sheet 54 to be wound on base member 15R. On the other hand, after allowing elastic layer 15B to be retreated, another elastic layer 15B having a thickness different from that of elastic layer 15B may be directly wound around the surface of base member 15R.

As described above, even in the case where the thickness of recording paper 10P is changed, image forming apparatus 200 can secure the same surface speed between intermediate transfer member 15 and paper conveying member 17 (recording paper 10P) without changing a rotational speed ratio between intermediate transfer member 15 and paper conveying member 17 arranged opposite to each other. Accordingly, occurrence of the shear can be suppressed. The rotation of seam 15J on intermediate transfer member 15 and the rotation of gripper 18 provided in paper conveying member 17 are synchronized at the same rotational speed (same angular speed). Therefore, improvement in accuracy of paper conveyance and widening of the image formation width can be both achieved.

ANOTHER MODIFIED EXAMPLE

In each of the embodiments described above, controller 40 automatically controls driving of adjusting device 20 based on information from torque detecting device 41, or controller 40 automatically drives only adjusting device 20 or both adjusting device 20 and replacing device 50 based on information from torque detecting device 41 and information from paper thickness information obtaining unit 42. However, these operation may be performed by an operator manually.

For example, an operator may operate adjusting device 20 to have a minimum driving torque with reference to a detection value from torque detecting device 41 to allow adjusting device 20 to adjust the axes distance between intermediate transfer member 15 and paper conveying member 17. Alternatively, in the case where the push-in amount (amount of collapse of elastic layer) between intermediate transfer member 15 and paper conveying member 17 is calculated based on the paper thickness information of recording paper 10P used for image formation and information of an adjustment value of the axes distance adjusted so as to have a minimum torque, and an operator determines that the linear pressure between the members deviates from an appropriate range, replacing device 50 may be operated to replace elastic layer 15B with another elastic layer 15B having a different thickness corresponding to the paper thickness.

In each of the embodiments described above, fixing rollers 33, 34 are used as fixing units of fixing device 32. Fixing device 32 may have a fixing unit for fixing a toner image by heating recording paper 10P without contact, may have a fixing unit for fixing a toner image by providing hot air, or may have a configuration with a combination of fixing units of contact type and/or non-contact type.

Each of the embodiments described above is described based on image forming apparatus 100 capable of performing so-called color printing including image forming units 1C, 1M, 1Y, 1K and four paper conveying members 17. However, the present invention is applicable also to an image forming apparatus for a single color and an image forming apparatus for two or three colors. The present invention is also applicable to only a specified color among a plurality of colors used in the image forming apparatus.

Image forming apparatuses 100, 200 described above are so-called wet-type image forming apparatuses. However, the paper conveying device of the present invention is applicable to an inkjet method or a dry-type electrographic method using dry-type toner. The paper conveying device of the present invention, is applicable also to the image forming process other than the electrographic type as long as it is an image forming apparatus having a configuration of winding a sheet (elastic layer) having an elastic layer on a surface.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A paper conveying device, comprising:

an image bearing body bearing an image on a surface and driven so as to rotate at a first rotational speed about a rotational axis as a center of rotation;

a paper conveying member conveying recording paper, to which said image is transferred, to a nip portion formed with said image bearing body, said paper conveying member arranged so as to be in press-contact with said image bearing body and driven so as to rotate at a second rotational speed about a rotational axis as a center of rotation;

a torque detecting device detecting first driving torque for rotating said image bearing body at said first rotational speed in a state of allowing said recording paper to pass through said nip portion and/or second driving torque for rotating said paper conveying member at said second rotational speed in a state of allowing said recording paper to pass through said nip portion as detection values; and an adjusting device capable of adjusting an axes distance between the rotational axis of said image bearing body and the rotational axis of said paper conveying member, an elastic layer being provided on an outer peripheral surface of said image bearing body and/or on an outer peripheral surface of said paper conveying member, and said first rotational speed and said second rotational speed have the same value or have values such that one value is an integer multiple of the other value, and said axes distance is adjusted by said adjusting device so that a sum of said first driving torque for rotating said image bearing body at said first rotational speed and said second driving torque for rotating said paper conveying member at said second rotational speed is smaller than a target set value.

2. The paper conveying device according to claim 1, further comprising a control unit for adjusting said axes distance based on said detection value detected by said torque detecting device.

3. The paper conveying device according to claim 2, further comprising:

a replacing device for replacing said elastic layer with another elastic layer having a thickness different from that of said elastic layer, wherein said control unit controls driving of said replacing device based on information related to a thickness of said recording paper to be used and information of an adjustment value of said axes distance by said adjusting device, and replaces said elastic layer with said another elastic layer.

4. The paper conveying device according to claim 1, wherein said image bearing body and said paper conveying member have a stepped portion formed so as to extend in an axial direction at least on one part of respective outer peripheral surfaces, and a stepped portion of said image bearing body and a stepped portion of said paper conveying member are synchronized in timing of passing through said nip portion.

5. The paper conveying device according to claim 4, wherein said elastic layer as a replaceable sheet-like member is provided on an outer peripheral surface of said image bearing body, and the stepped portion of said image bearing body is a seam of said elastic layer, and a gripping member for gripping a front end portion of said recording paper is provided on said paper conveying member, and a stepped portion of said paper conveying member is a stepped portion produced at the position arranged with said gripping member.

6. The paper conveying device according to claim 1, wherein said first rotational speed and said second rotational speed have the same value, and said image bearing body has said elastic layer provided on an outer peripheral surface, and said paper conveying member is a rigid member without said elastic layer on outer peripheral surface, and an outer diameter of said image bearing body including said elastic layer is smaller than an outer diameter of said paper conveying member.

7. An image forming apparatus comprising:

the paper conveying device according to claim 1; and an image forming unit for forming said image, said image formed by said image forming unit is sequentially transferred to said image bearing body and said recording paper conveyed by said paper conveying member to form an output image onto said recording paper.

8. The image forming apparatus according to claim 7, wherein said image forming unit uses a liquid developer containing toner dispersed in carrier liquid.

9. A push-in amount adjusting method for adjusting a push-in amount of a paper conveying member of a paper conveying device with respect to an image bearing body, said paper conveying device including:

said image bearing body bearing an image on a surface and rotating about a rotational axis as a center of rotation;

said paper conveying member conveying recording paper, to which said image is transferred, to a nip portion formed with said image bearing body, said paper conveying member arranged so as to be in press-contact with said image bearing body and rotating about a rotational axis as a center of rotation; and an adjusting device capable of adjusting an axes distance between the rotational axis of said image bearing body and the rotational axis of the said paper conveying member, an elastic layer being provided on an outer peripheral surface of said image bearing body and/or on an outer peripheral surface of said paper conveying member, the push-in amount adjusting method comprising:

a first step of rotating said image bearing body and said paper conveying member so as to have the same value of the rotational speed or have the values of the rotational speeds such that one value is an integer multiple of the other value;

a second step of detecting first driving torque of said image bearing body in a state of allowing said recording paper to pass through said nip portion and/or second driving torque of said paper conveying member in a state of allowing said recording paper to pass through said nip portion as detection values; and a third step of adjusting said axes distance with use of said adjusting device so that a sum of said first driving torque and said second driving torque is smaller than a target set value in accordance with said detection values detected in said second step.

10. The push-in amount adjusting method according to claim 9, said elastic layer being provided so as to be replaceable with another elastic layer having a different thickness, the method comprising between said first step and said second step:

a step of replacing said elastic layer with said another elastic layer based on information related to a thickness of said recording paper to be used and information of an adjustment value of said axes distance.

* * * * *